US008863563B2

(12) United States Patent
Gentile et al.

(10) Patent No.: US 8,863,563 B2
(45) Date of Patent: Oct. 21, 2014

(54) MAGNETIC LOCK AND KEY ASSEMBLY

(75) Inventors: Frank L. Gentile, Seymour, CT (US); Mark Nickeas, Westlake Village, CA (US); Martin Nickeas, Oxnard, CA (US)

(73) Assignee: Rexnord Industries, LLC, Milwaukee, WI (US)

( * ) Notice: Subject to any disclaimer, the term of this patent is extended or adjusted under 35 U.S.C. 154(b) by 155 days.

(21) Appl. No.: 13/561,785

(22) Filed: Jul. 30, 2012

(65) Prior Publication Data

US 2012/0291501 A1 Nov. 22, 2012

Related U.S. Application Data

(63) Continuation-in-part of application No. 13/034,499, filed on Feb. 24, 2011, now abandoned, and a continuation-in-part of application No. 13/400,428, filed on Feb. 20, 2012.

(60) Provisional application No. 61/308,466, filed on Feb. 26, 2010, provisional application No. 61/444,856, filed on Feb. 21, 2011.

(51) Int. Cl.
*E05B 47/00* (2006.01)
*E05B 67/36* (2006.01)

(52) U.S. Cl.
CPC ..... *E05B 67/365* (2013.01); *E05B 47/0045* (2013.01); *E05B 47/0038* (2013.01)
USPC ..... 70/276; 70/34; 70/57.1; 70/413; 24/303; 403/322.1

(58) Field of Classification Search
USPC ..... 70/34, 386, 276, 413, 57.1; 24/635, 24/706.8, 303; 403/322.1, 322.2, 316
See application file for complete search history.

(56) References Cited

U.S. PATENT DOCUMENTS

| | | | |
|---|---|---|---|
| 1,154,078 | A | 9/1915 | Upton |
| 1,434,110 | A | 10/1922 | Freysinger |
| 2,049,742 | A | 8/1936 | Lowe |
| 2,121,301 | A | 6/1938 | Ractliffe |
| 2,177,996 | A | 10/1939 | Raymond |
| 3,234,767 | A | 2/1966 | Allander |

(Continued)

OTHER PUBLICATIONS

Highfield Mfg. Co. Drawing of Beta Lock With Seal, Aug. 11, 1997.

(Continued)

*Primary Examiner* — Suzanne Barrett
(74) *Attorney, Agent, or Firm* — Quarles & Brady LLP

(57) ABSTRACT

A magnetic lock and key assembly includes a magnetic lock assembly. The magnetic lock assembly includes a plunger translatable between a locked position and an unlocked position. A detent is extendable when the plunger is in the locked position and retractable when the plunger is in the unlocked position. A lock magnet is translatable with the plunger and has an end defined by a lock magnet north pole and a lock magnet south pole. The magnetic lock and key assembly further includes a magnetic key assembly having a key magnet. The key magnet has an end defined by a key magnet north pole and a key magnet south pole. At least one of the lock magnet and the key magnet is rotatably supported to facilitate automatic magnetic attractive alignment, attraction of the lock magnet toward the key magnet, and translation of the plunger to the unlocked position.

18 Claims, 21 Drawing Sheets

(56) References Cited

U.S. PATENT DOCUMENTS

| | | | | | |
|---|---|---|---|---|---|
| 3,421,348 | A | | 1/1969 | Hallmann | |
| 3,602,020 | A | | 8/1971 | Kajita | |
| 3,633,393 | A | * | 1/1972 | Hisatsune | 70/276 |
| 3,656,328 | A | | 4/1972 | Hughes | |
| 3,757,551 | A | | 9/1973 | Willach | |
| 3,782,147 | A | * | 1/1974 | Hallmann | 70/276 |
| 3,797,288 | A | * | 3/1974 | Hallmann | 70/276 |
| 3,858,280 | A | | 1/1975 | Martens | |
| 3,965,710 | A | | 6/1976 | McCurdy | |
| 3,967,479 | A | | 7/1976 | Vick | |
| 4,096,718 | A | | 6/1978 | Michelman et al. | |
| 4,228,667 | A | | 10/1980 | Herriott | |
| 4,287,733 | A | | 9/1981 | Gomez-Olea | |
| 4,294,091 | A | | 10/1981 | Prunbauer | |
| 4,333,327 | A | * | 6/1982 | Wake | 70/276 |
| 4,380,162 | A | | 4/1983 | Woolfson | |
| 4,414,915 | A | | 11/1983 | Graybeal | |
| 4,440,007 | A | | 4/1984 | Prunbauer | |
| 4,476,701 | A | | 10/1984 | Herriott | |
| 4,631,939 | A | | 12/1986 | Herriott | |
| 4,815,304 | A | | 3/1989 | Kesselman | |
| 4,841,758 | A | | 6/1989 | Ramblier | |
| 5,611,223 | A | | 3/1997 | Spitzer | |
| 5,870,909 | A | | 2/1999 | Saunders, Jr. et al. | |
| 6,386,006 | B1 | | 5/2002 | DeWalch | |
| 6,705,139 | B2 | | 3/2004 | Tsai | |
| 6,763,691 | B1 | | 7/2004 | Rafferty | |
| 7,125,058 | B2 | | 10/2006 | Hawthorne | |
| 7,267,378 | B2 | * | 9/2007 | Drumm | 292/251.5 |
| 8,083,274 | B2 | | 12/2011 | Caldwell et al. | |
| 2007/0028429 | A1 | * | 2/2007 | Ishida | 24/303 |
| 2011/0209509 | A1 | | 9/2011 | Nickeas et al. | |

OTHER PUBLICATIONS

United States Patent and Trademark Office, Office Action Summary and Detailed Action, U.S. Appl. No. 13/034,499, Oct. 14, 2011.

Applicant, First Amendment (Response to Oct. 14, 2011 Office Action), U.S. Appl. No. 13/034,499, Jan. 13, 2012.

United States Patent and Trademark Office, Office Action Summary and Detailed Action, U.S. Appl. No. 13/034,499, Feb. 6, 2012.

Applicant, Second Amendment (Response to Feb. 6, 2012 Office Action), U.S. Appl. No. 13/034,499, Apr. 23, 2012.

United States Patent and Trademark Office, Advisory Action Before the Filing of an Appeal Brief, U.S. Appl. No. 13/034,499, May 2, 2012.

United States Patent and Trademark Office, Office Action Summary and Detailed Action and Examiner-Initiated Interview Summary, U.S. Appl. No. 13/034,499, May 29, 2012.

Applicant, Third Amendment (Response to May 29, 2012 Office Action), U.S. Appl. No. 13/034,499, Aug. 29, 2012.

United States Patent and Trademark Office, Office Action Summary and Detailed Action, U.S. Appl. No. 13/034,499, Sep. 18, 2012.

Applicant, Interview Summary, U.S. Appl. No. 13/034,499, Oct. 31, 2012.

United States Patent and Trademark Office, Applicant-Initiated Interview Summary, U.S. Appl. No. 13/034,499, Nov. 6, 2012.

* cited by examiner 1500
1502
1504
1506
1508
1510
1512
1514
1516
1518
1520
1522
1524
1526
1528
1530
1532
1534
1536
1538
1540
1542
1544
1546
1548
1550
1552
1554
1556
1558
1560
1562
1564
1566
1568
1570
1572
1574
1576
1578
1580

MAGNETIC LOCK AND KEY ASSEMBLY

CROSS REFERENCES TO RELATED APPLICATIONS

This application is a continuation-in-part of U.S. application Ser. No. 13/034,499 filed Feb. 24, 2011, which claims priority to U.S. provisional application No. 61/308,466 filed Feb. 26, 2010. This application is also a continuation-in-part of U.S. application Ser. No. 13/400,428 filed Feb. 20, 2012, which claims priority to U.S. provisional application No. 61/444,856 filed Feb. 21, 2011. The above-listed applications are incorporated by reference as if fully set forth herein.

STATEMENT REGARDING FEDERALLY SPONSORED RESEARCH

Not applicable.

BACKGROUND

The present disclosure relates generally to a magnetic lock assembly. More particularly, the disclosure describes a magnetic lock assembly configured to operate in cooperation with a corresponding magnetic key assembly.

Many conventional locks include internal lock components that are mechanically engaged by a key inserted into an opening in the lock. This general lock configuration incorporates a number of precision elements that must work in concert to ensure proper operation of the lock. In addition, the opening in the lock hampers the operational life and ultimate security afforded by the lock. For instance, debris, such as dust, water, and other contaminants can enter the lock through the opening and foul the internal lock components. Furthermore, nefarious characters exploit the key opening in efforts to tamper with and defeat the security aspects of the lock.

In light of at least the above considerations, a need exists for a lock assembly having improved construction and operation.

SUMMARY

In one aspect, a magnetic lock and key assembly comprises a magnetic lock assembly. The magnetic lock assembly includes a lock body that defines a chamber and a plunger disposed within the chamber. The plunger is translatable in a longitudinal axial direction between a locked position and an unlocked position. A resilient member urges the plunger toward the locked position. A detent is extendable when the plunger is in the locked position and retractable when the plunger is in the unlocked position. A lock magnet is disposed within the chamber and is translatable with the plunger as the plunger translates between the locked position and the unlocked position. The lock magnet has an end defined by a lock magnet north pole and a lock magnet south pole. The magnetic lock and key assembly further comprises a magnetic key assembly that includes a collet configured to connect to the lock body. A key magnet is supported within the collet, and the key magnet has an end defined by a key magnet north pole and a key magnet south pole. At least one of the lock magnet is rotatably supported by the lock body and the key magnet is rotatably supported by the collet to facilitate automatic magnetic attractive alignment of the lock magnet and the key magnet about the longitudinal axial direction. This also facilitates magnetic attraction between the lock magnet north pole and the key magnet south pole and between the lock magnet south pole and the key magnet north pole to translate the plunger to the unlocked position.

In another aspect, a magnetic key assembly comprises a collet configured to connect to a magnetic lock assembly. A rod is supported within the collet and is translatable in a longitudinal axial direction between an actuated position and a non-actuated position. A key magnet is translatable within the collet due to movement of the rod between the actuated position and the non-actuated position. The key magnet has a longitudinal axial end opposite the rod, and the longitudinal axial end is defined by a key magnet north pole and a key magnet south pole. Connecting the collet to the magnetic lock assembly and positioning the key magnet near a lock magnet of the magnetic lock assembly having an end defined by a lock magnet north pole and a lock magnet south pole automatically magnetically attractively aligns the key magnet and the lock magnet and attracts the lock magnet toward the key magnet to unlock the magnetic lock assembly.

In a further aspect, a magnetic lock assembly comprises a lock body defining a chamber having a first end and an opposite second end. A plunger is disposed within the chamber and is translatable in a longitudinal axial direction between a locked position and an unlocked position. A resilient member urges the plunger toward the locked position, and a detent is extendable when the plunger is in the locked position and retractable when the plunger is in the unlocked position. A lock magnet is translatable with the plunger as the plunger moves between the locked position and the unlocked position. The lock magnet has a longitudinal axial end proximate the second end of the chamber, and the longitudinal axial end is defined by a lock magnet north pole and a lock magnet south pole. Positioning a key magnet having an end defined by a key magnet north pole and a key magnet south pole proximate the second end of the chamber automatically magnetically attractively aligns the key magnet and the lock magnet about the longitudinal axial direction. This also attracts the lock magnet toward the key magnet and moves the plunger to the unlocked position such that the detent may retract.

The above and other aspects of the disclosure will be apparent from the description that follows. In the detailed description, preferred example embodiments will be described with reference to the accompanying drawings. These embodiments do not represent the full scope of the invention; rather, the invention may be employed in many other embodiments. Reference should therefore be made to the claims for determining the full breadth of the invention.

DETAILED DESCRIPTION OF THE PREFERRED EXAMPLE EMBODIMENTS

Those skilled in the art, given the benefit of this disclosure, will understand that the inventive concepts can be adapted for use with a variety of magnetic lock assembly and magnetic key assembly configurations, and are not unduly limited by the example lock assemblies and key assembly described herein.

Figure 1:
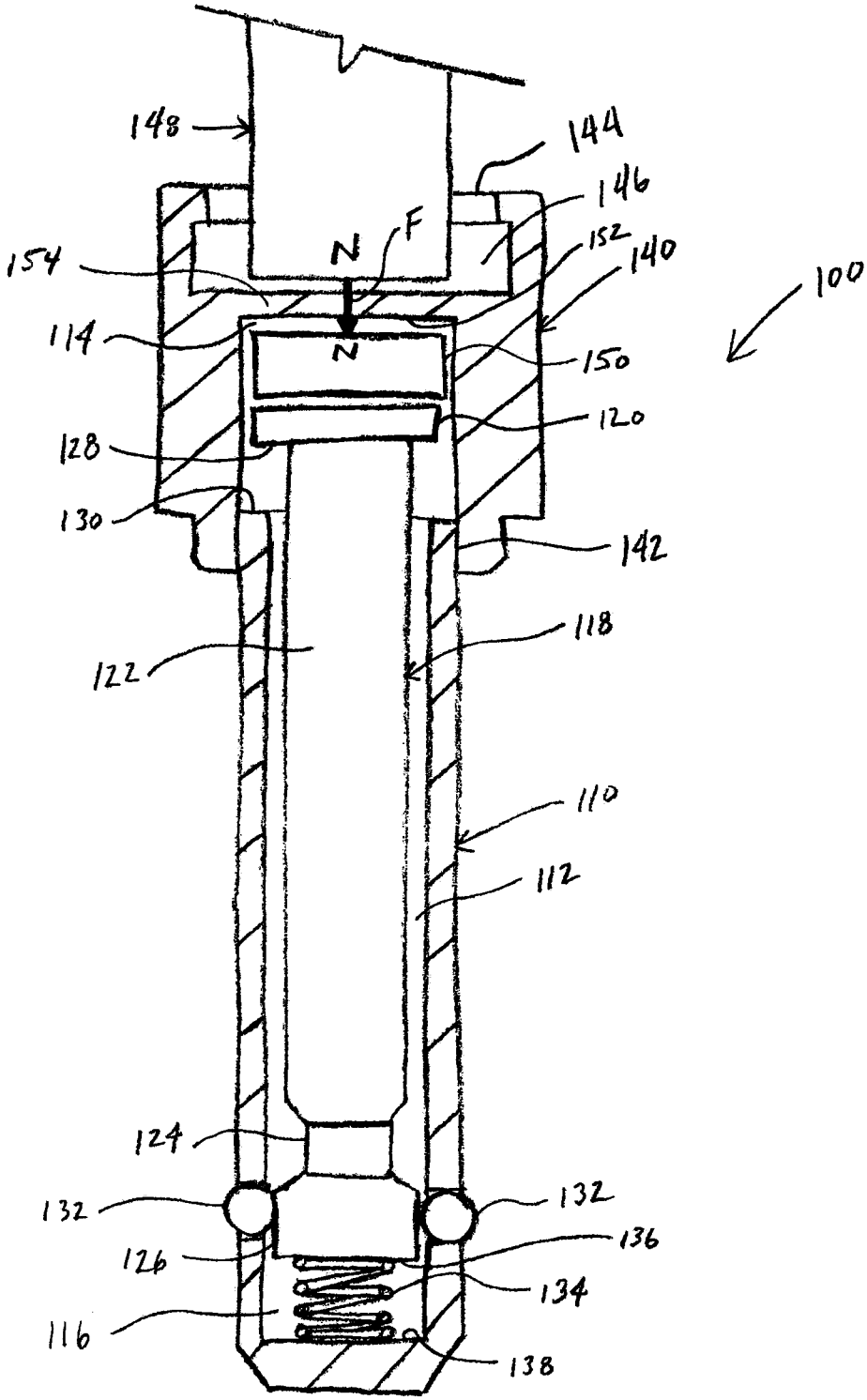
FIG. 1 is a partial section view of an example magnetic barrel lock assembly illustrating a magnetic key engaged and a plunger still in a locked position.

A first example magnetic barrel lock assembly (100) is shown in FIG. 1. In the example configuration illustrated, the magnetic barrel lock assembly (100) includes a lock body (110) that is cylindrically shaped. The lock body (110) defines a chamber (112) generally having a first end (114) and a second end (116) opposite the first end (114). The lock body (110) is preferably metallic (e.g., hardened steel) to provide resistance to cutting and deformation; however, certain applications may allow the lock body (110) to be constructed from plastic or other non-metallic materials.

Figure 2:
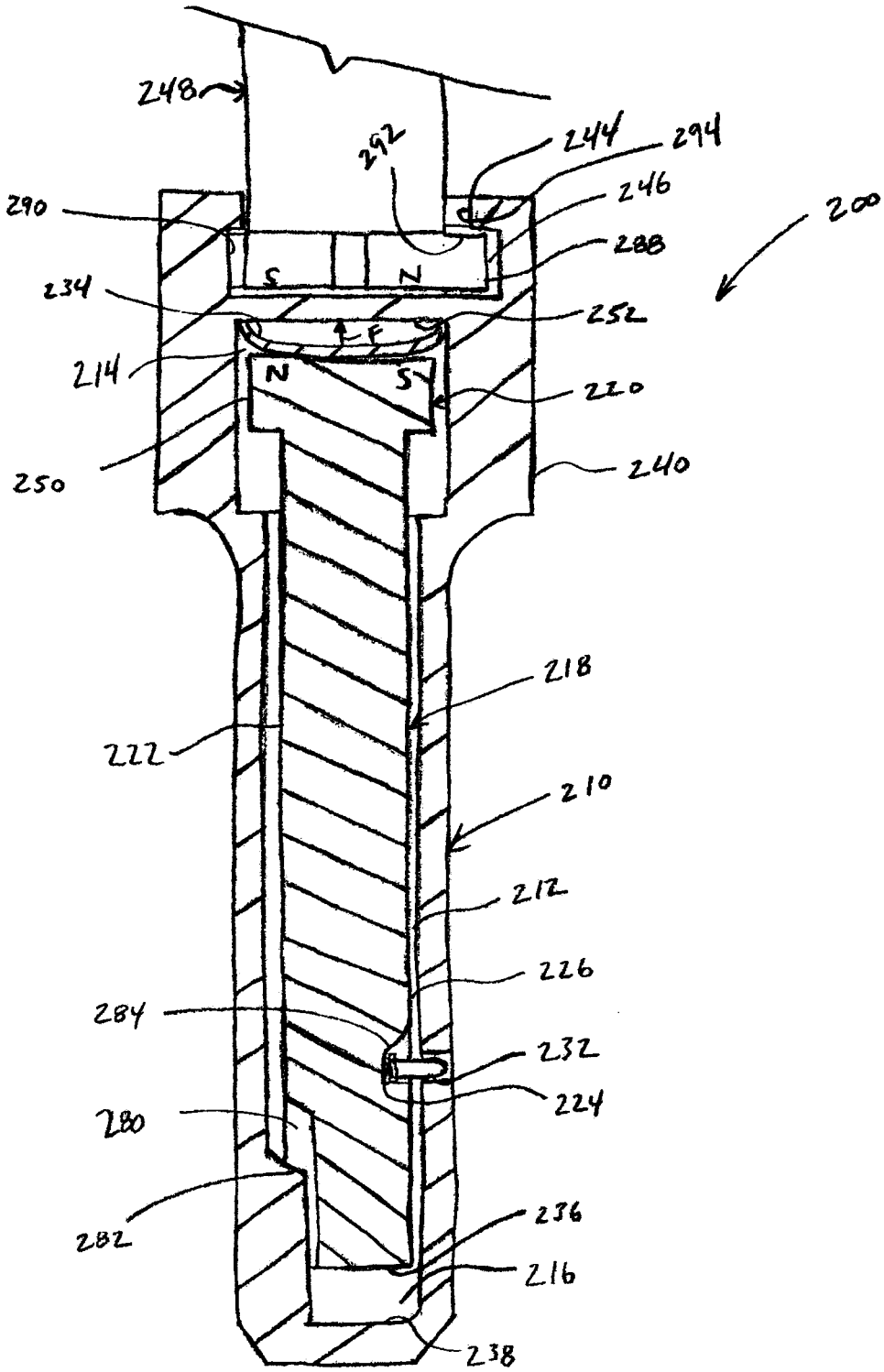
FIG. 2 is a partial section view of another example magnetic barrel lock assembly illustrating a magnetic key engaged and a plunger in an unlocked position.

A plunger (118) is located within the chamber (112) such that the plunger (118) shown in the example embodiment can be moved axially between a locked position (shown in FIG. 1) and an unlocked position (shown in FIG. 2 with reference to an alternative example embodiment). The plunger (118) is also cylindrical to provide a compatible form factor with the cylindrical chamber (112) formed within the lock body (110). The lock body (110), chamber (112), and plunger (118) may be configured with any number of similar or distinct form factors provided the plunger (118) is capable of operation within the chamber (112), that is, the plunger (118) can move between the locked and unlocked positions during operation of the magnetic barrel lock assembly (100). Furthermore, the plunger (118) is preferably metallic to provide sufficient robustness; again, however, when application requirements allow, the plunger (118) may be constructed from plastic or any other suitable non-metallic materials.

The plunger (118) includes a head portion (120) near the first end (114) of the chamber (112), a shaft portion (122) adjacent the head portion (120), a recess (124) adjacent the shaft portion (122), and a lock portion (126) near the second end (116) of the chamber (112). The head portion (120) includes a lip (128) configured to engage a rim (130) formed by the lock body (110) when the plunger (118) of the magnetic barrel lock assembly (100) is moved into the fully unlocked position (not shown).

The recess (124) is formed by a neck between the shaft portion (122) and the lock portion (126), and is configured to receive and engage one or more detent(s) (132) when the plunger (118) is in the unlocked position (shown in FIG. 2) and the detent (132) is retracted. In the example embodiment illustrated in FIG. 1, the detents (132) include a pair of balls incorporated as understood by one of ordinary skill in the art and are shown extended. Alternatively, or in addition, the detent(s) (132) may comprise pins, blocks, and the like. The lock portion (126) is configured to engage the detents (132) when the plunger (118) is in the locked position and prevent the detents (132) from retracting into the chamber (112); as a result, the magnetic barrel lock (100) is inhibited from axial movement when engaged with a mating lock member, such as the panel lock for a utility access box (not shown), as is understood by one of ordinary skill in the art.

In the example magnetic barrel lock assembly (100) illustrated in FIG. 1, a resilient member (134) is located between an end face (136) of the plunger (118) and an end face (138) of the chamber (112) near the second end (116). The resilient member (134) is shown as a compression spring, but may take on a variety of other forms, such as, a spring washer or an elastomeric member. The resilient member (134) is configured to bias the plunger (118) toward the first end (114) of the chamber (112) and maintain the magnetic barrel lock assembly (100) in the locked position until desired.

In the example embodiment illustrated in FIG. 1, the lock body (110) includes a cap (140) that engages (e.g., is welded to) a first end (142) of the lock body (110) and defines the first end (114) of the chamber (112). In addition, the cap (140) defines a keyed opening (144) providing restricted access to a key cavity (146). As shown in FIG. 1, the keyed opening (144) is generally circular to allow access by a circular key magnet (148) through the keyed opening (144) and into the key cavity (146) toward the first end (114) of the chamber (112). The cap (140) is also preferably metallic and similarly resistant to tampering. The cap (140) may be integrally formed with the balance of the lock body (110) (e.g., as shown in FIG. 2) and seals the chamber (112), and components therein, to prevent debris from fouling the operation of internal components. Furthermore, tampering with the internal operation of the magnetic barrel lock assembly (100) is inhibited as no opening is present.

With continued reference to the example embodiment shown in FIG. 1, a lock magnet (150) is located between the head portion (120) of the plunger (118) and an end face (152) of the chamber (112) near the first end (114) of the chamber (112). The lock magnet (150) is configured to magnetically interact with the key magnet (148) such that when the key magnet (148) is positioned into the key cavity (146) near the lock magnet (150), a lock magnet polarity and a key magnet polarity will repel the lock magnet (150) away from the key magnet (148). Therefore, axially fixing the key magnet (148) within the key cavity (146) results in the lock magnet (150) being urged in the general direction of arrow F on FIG. 1, and thus moves the plunger (118) axially within the chamber (112). The plunger (118) in FIG. 1 is shown prior to being urged by the lock magnet (150). As the plunger (118) moves toward the second end (116) of the chamber (112) into the unlocked position, the recess (124) is aligned with the detent (132) such that the detent (132) may retract into the recess (124), and the magnetic barrel lock assembly (100) may therefore be removed from a particular application.

In a basic form illustrated in FIG. 1, a magnetic north pole of the key magnet (148) is oriented near a magnetic north pole of the lock magnet (150), resulting in sufficient magnetic repulsion to overcome the resistance of the resilient member (134) and move the plunger (118). Conversely, removing the key magnet (148) from the key cavity (146) results in the resilient member (134) biasing the plunger (118) back into the locked position.

As those skilled in the art will appreciate, how "near" the key magnet (148) and lock magnet (150) must be in order to move the plunger (118) is dependent upon a variety of variables, including, the magnetic field strength of the key magnet (148) and lock magnet (150), the material composition of the cap (140), the thickness of a cap web (154), and the biasing force provided by the resilient member 134, for instance. In one embodiment, the key magnet (148) and the lock magnet (150) are positioned within one inch in order to move the plunger (118) into the unlocked position. The distance required to operate the magnetic barrel lock assembly (100) may be tailored to meet given application requirements, as understood by those skilled in the art.

In preferred forms, the key magnet (148) and the lock magnet (150) are permanent magnets made from a material having a high magnetic field to weight ratio, such as rare earth neodymium magnets. Those skilled in the art, given the benefit of this disclosure, will appreciate the variety of magnet types and compositions suitable for use in accordance with the magnetic barrel lock assembly (100).

Turning to FIG. 2, a second example magnetic barrel lock assembly (200) is illustrated. In this example configuration, the magnetic barrel lock assembly (200) includes a lock body (210) defining an enclosed chamber (212) having a first end (214) and a second end (216). The lock body (210) is formed to include an upper portion (240) as opposed to the separate cap (140) as shown in FIG. 1.

A plunger (218) is located within the chamber (212) such that the plunger (218) can be moved axially between the locked position (shown in FIG. 1 in context of the magnetic barrel lock assembly (100)) and an unlocked position (shown in FIG. 2). As with the first example magnetic barrel lock assembly (100), the lock body (210), chamber (212), and plunger (218) may be configured with any number of similar or distinct form factors provided the plunger (218) is capable of moving within the chamber (212) between the locked and unlocked positions during operation of the magnetic barrel lock assembly (200).

The plunger (218) includes a head portion (220) near the first end (214) of the chamber (212), a shaft portion (222) adjacent the head portion (220), a recess (224) adjacent the shaft portion (222), and a lock portion (226) between the shaft portion (222) and the recess (224). An end face (236) of the plunger (218) is configured to engage an end face (238) of the chamber (212) near the second end (216) when the plunger (218) of the magnetic barrel lock assembly (200) is moved into the fully locked position (not shown). The plunger (218) further includes a recess (280) in the form of a longitudinal groove that is configured to engage a protrusion (282) in the form of a tongue extending from the lock body (210). The engagement between the recess (280) and the protrusion (282) inhibits relative rotation between the plunger (218) and the lock body (210) while allowing the plunger (218) to slide axially within the chamber (212).

When the plunger (218) is in the unlocked position (shown in FIG. 2), the recess (224) is aligned with a detent (232) in the form of a pin such that the detent (232) may retract toward the chamber (212) and into the recess (224) formed in the plunger (218). The detent (232) need not retract completely into the lock body (210) when the plunger is in the unlocked position, provided the appropriate allowance is made in the mating lock member, as understood by one of ordinary skill in the art. The recess (224) further defines a ramp (284) that the detent (232) cams against as the plunger (218) moves from the unlocked position shown in FIG. 2 to a locked position at which the detent (232) is extended.

In the example magnetic barrel lock assembly (200) illustrated in FIG. 2, a resilient member (234) is located near the first end (214) of the chamber (212) between an end face (252) of the chamber (212) and the plunger (218). The resilient member (234) is shown as a spring washer that flattens out under compression and rebounds to a dome shape to bias the plunger (218) toward the second end (216) of the chamber (212), thus maintaining the magnetic barrel lock assembly (200) in the locked position until desired.

Figure 3:
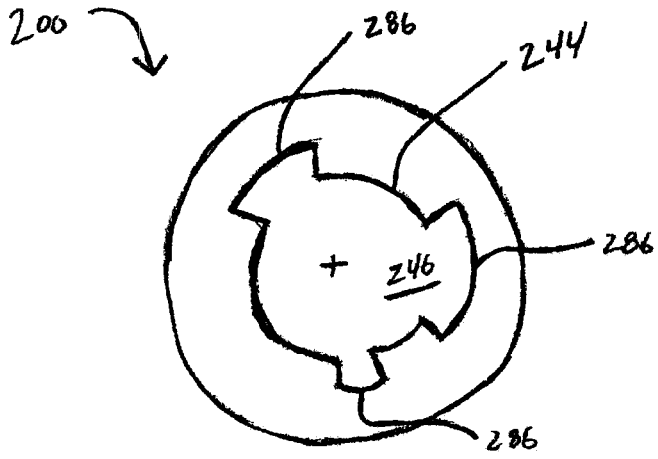
FIG. 3 is an end view of an example keyed opening.

In the example embodiment shown in FIG. 2, the lock body (210) includes an integrated keyed opening (244) that provides further restricted access to a key cavity (246). As shown in FIG. 3, the example keyed opening (244) includes a series of notches (286) that match with a contoured head (288) of a key magnet (248), and provide an interlock configuration such that the key magnet (248) is selectively, axially captured to the lock body (210) to allow removal of the magnetic barrel lock assembly (200) from a mating lock member via the key magnet (248). For instance, a lip (292) of the key magnet (248) may be positioned within the key cavity (246) and rotated such that the lip (292) is adjacent one or more radially inward extending rims (294); attempting to remove the key magnet (248) when in this orientation results in the lip (292) engaging the rim (294) such that the key magnet (248) urges the entire magnetic barrel lock assembly (200) away from the mating lock member.

With continued reference to the example embodiment shown in FIG. 2, a lock magnet (250) is integral with the head portion (220) of the plunger (218). Converse to the magnetic barrel lock assembly (100), the lock magnet (250) is configured to magnetically interact with the key magnet (248) such that when the key magnet (248) is positioned into the key cavity (246) near the lock magnet (250), a lock magnet polarity and a key magnet polarity will attract the lock magnet (250) (and thus plunger (218)) toward the key magnet (248). Therefore, holding the key magnet (248) stationary within the key cavity (246) results in the lock magnet (250) being urged in the general direction of arrow F on FIG. 1, and thus moves the plunger (218) axially within the chamber (212) to the unlocked position. As the plunger (218) moves, the recess (224) is aligned with the detent (232) to allow the detent (232) to retract toward the chamber (212).

Figure 4:
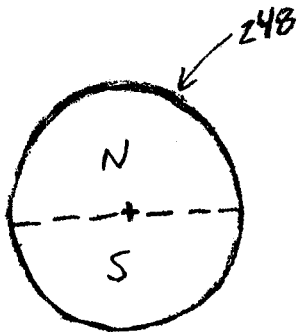
FIG. 4 is an example key/plunger polarity code configuration.

In one form, illustrated best in FIGS. 2 and 4, the key magnet (248) includes two magnets arranged generally into two halves of a disc and defines a key polarity code (i.e., N-S as oriented as shown in FIG. 4). The lock magnet (250) also includes two magnets arranged generally into two halves of a disc and defines a lock polarity code (i.e., N-S as oriented in FIG. 4). Inserting the key magnet (248) into the key cavity (246) and aligning the key magnet (248) such that the key polarity code is inverse of the lock polarity code (i.e., orienting the opposite N-S poles on the key magnet (248) and lock magnet (250), respectively, to maximize the attractive force) causes attraction between the key magnet (248) and lock magnet (250), which is integral with the plunger (218). The key magnet (248), lock magnet (250), and resilient member (234) are configured such that the magnetic attraction is sufficient to move the plunger (218) into the unlocked position shown in FIG. 2.

Figure 5:
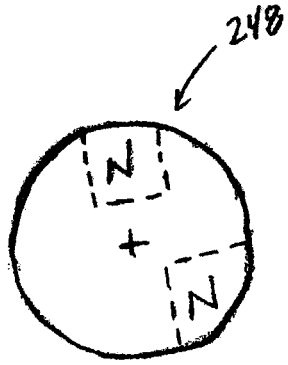
FIG. 5 is another example key/plunger polarity code configuration.

In the embodiment shown in FIGS. 2 and 3, the contoured head (288) of the key magnet (248) is inserted through the keyed opening (244) and into the key cavity (246) toward the first end (214) of the chamber (212). To provide additional security, the key cavity (246) may include one or more walls (290) that restrict rotation of the key magnet (248) and limit key magnet (248) orientations that result in operational interaction between the key magnet (248) and a lock magnet (250) integrated into the head portion (220) of the plunger (218). For instance, FIG. 5 illustrates an alternative key magnet (248) and lock magnet (250) polarity code, in which aligning the two off-center north magnetic poles repels the lock magnet (250) from the key magnet (248), such as in the magnetic barrel lock assembly (100) shown in FIG. 1. The configuration of unique polarity codes defining the magnetic interaction between the key magnet (248) and the lock magnet (250), and the various keyed opening (244) form factors provide numerous combinations for a robust magnetic barrel lock assembly (200), as will be appreciated by one of ordinary skill in the art in view of this disclosure.

Figure 6:
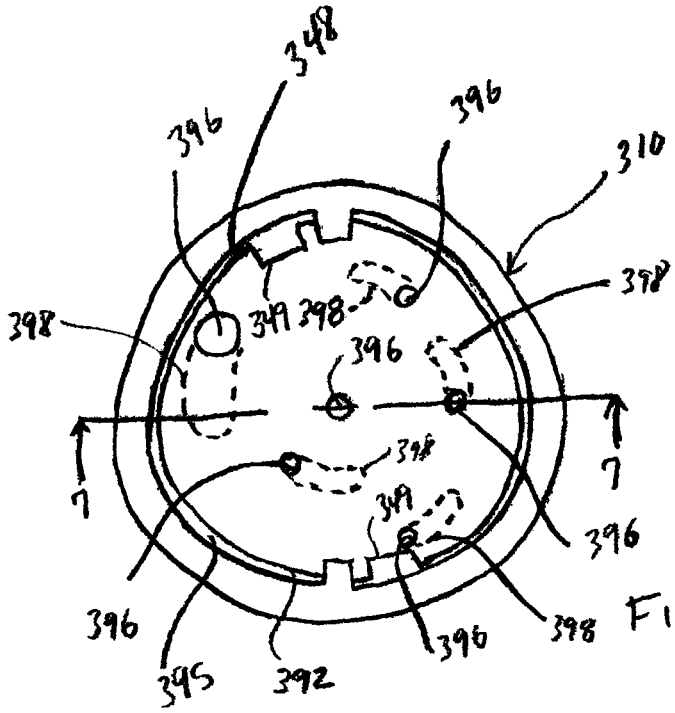
FIG. 6 is a partial top view of an example interlock configuration.
Figure 7:
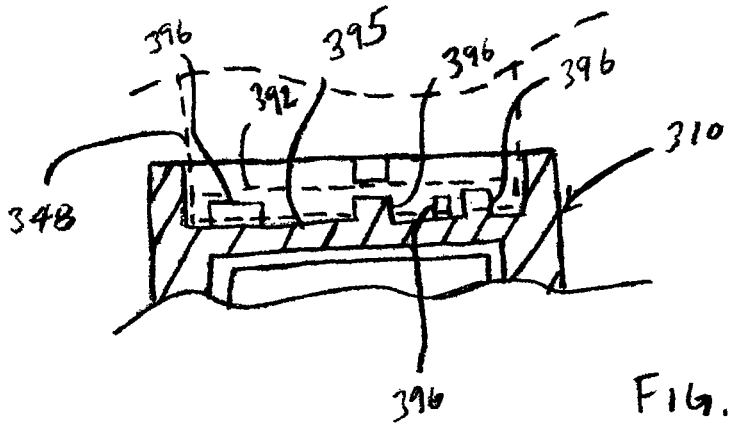
FIG. 7 is a cross section along line 7-7 of FIG. 6.

Another example interlock configuration generally between a lock body (310) and a key magnet (348) is illustrated in FIGS. 6 and 7. In the example shown, the lock body (310) includes an axial face (395) from which a series of cylindrical standoffs (396) extend at various locations. A key magnet (348) for use with the specific interlock configuration includes as series of mating radial slots (398) (shown as dashed lines in FIG. 6). In operation, the counterclockwise ends of the respective radial slots (398) are aligned with the standoffs (396), and notches (349) are aligned with respective rims (394). The key magnet is then rotated counterclockwise (as shown in FIG. 6) until the standoffs (396) abut the clockwise ends of the radial slots (398). In this orientation, a lip (392) of the key magnet (348) is aligned adjacent the rims (394) extending radially inward such that the key magnet (348) is axially captured to the lock body (310) and can be used to remove the lock body (310) from the particular lock member. The height of the standoffs (396) as measure relative to the axial face (395) can be varied as required to prevent a non-interlocking key magnet from being placed near enough to magnetically cause the magnetic barrel lock assembly to move to the unlocked position. Moreover, the number, placement, and form factor of the standoffs (396) may be varied, as understood by those skilled in the art given the benefit of this disclosure.

Figure 8:
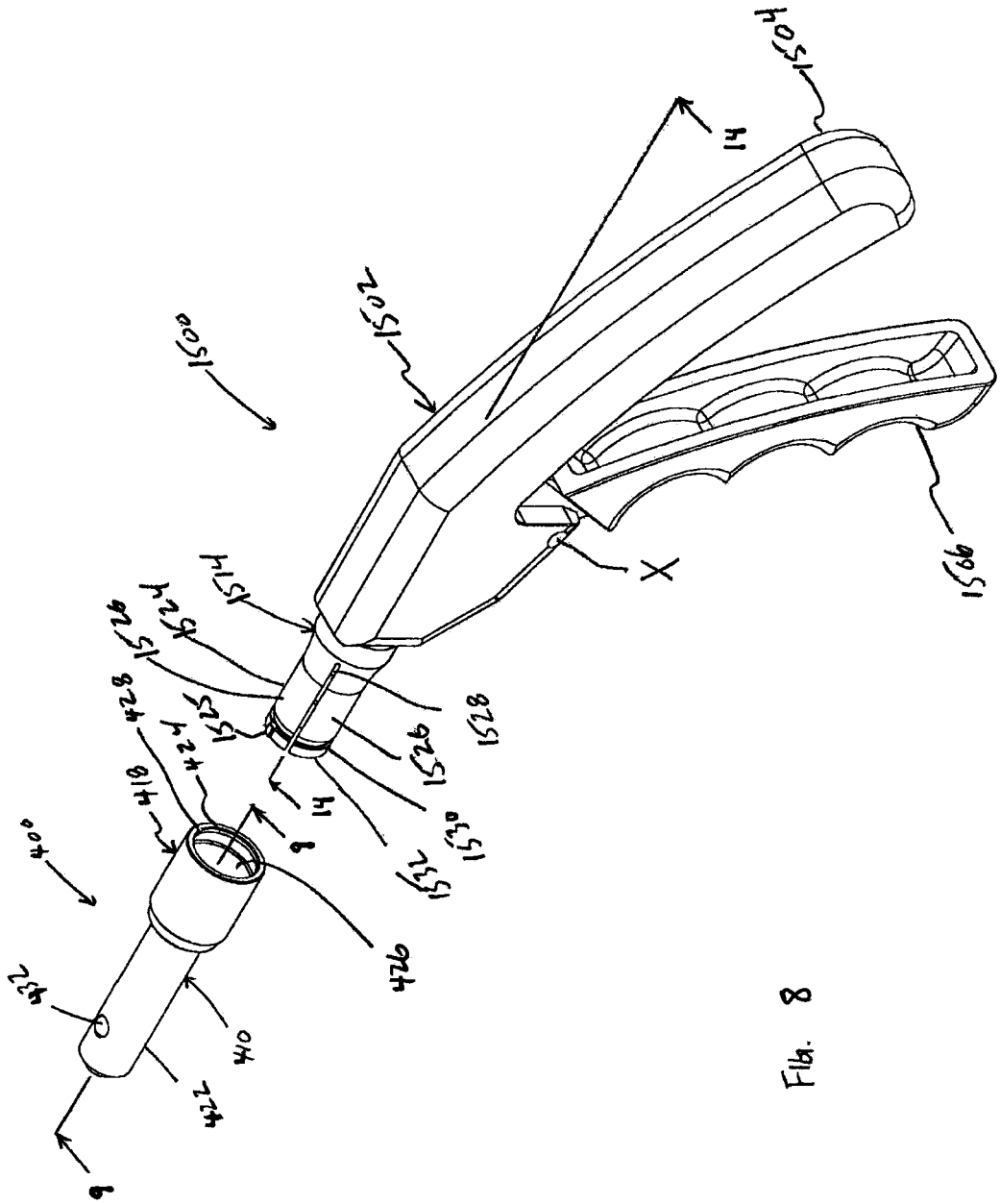
FIG. 8 is an isometric view of another example magnetic lock assembly and another example magnetic key assembly.

An example magnetic lock assembly is shown in FIG. 8 in the form of a magnetic barrel lock assembly (400) ("lock assembly (400)"). In addition, an example magnetic key assembly is illustrated in FIG. 8 in the form of a pistol-grip style magnetic key assembly (1500) ("key assembly (1500)").

Figure 9:
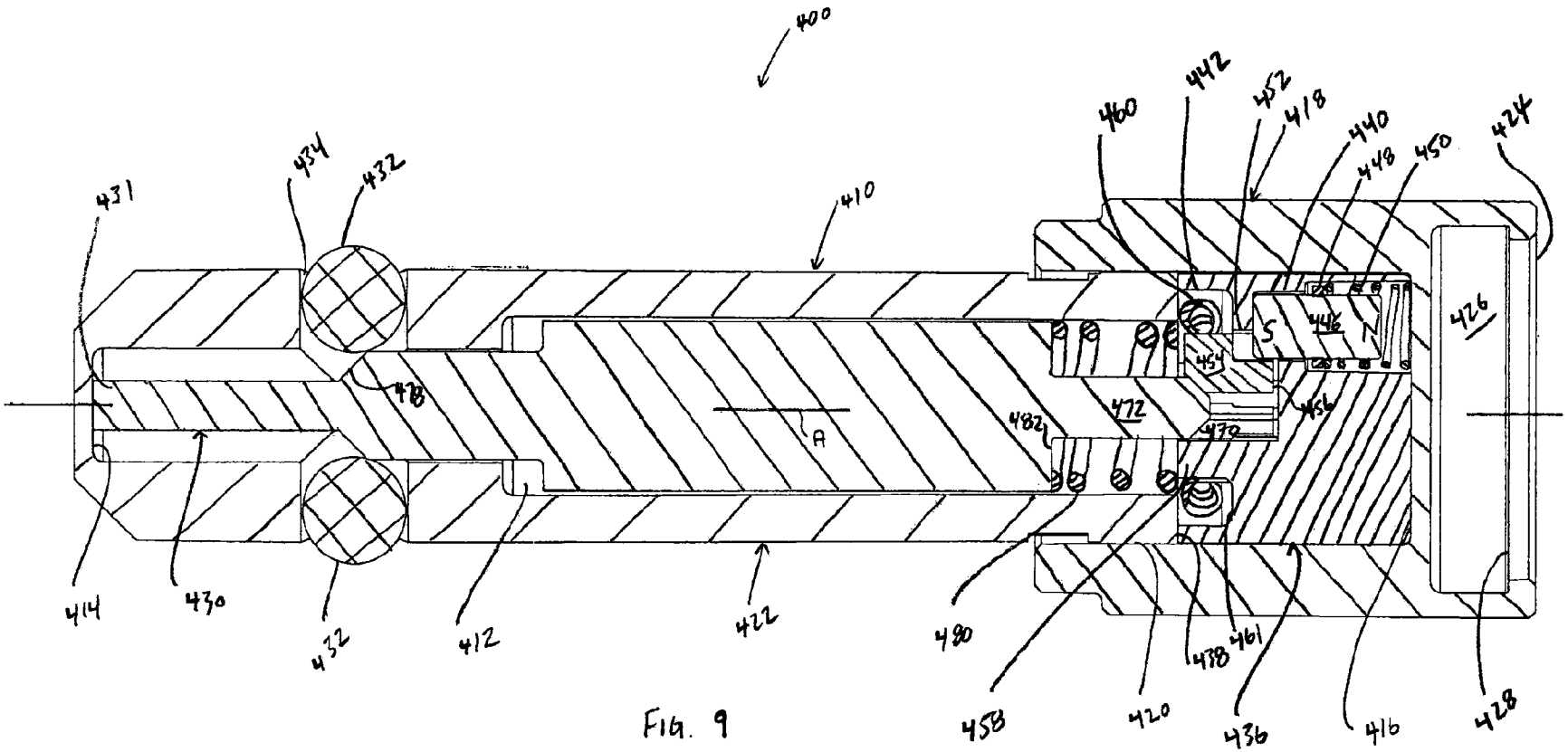
FIG. 9 is a section view of the example magnetic lock assembly along line 9-9 of FIG. 8 illustrating an example longitudinal member in a block position and an example transverse member in an engaged position.

In the example configuration, and with additional reference to FIG. 9, the lock assembly (400) includes a lock body (410) having a generally cylindrical form factor. The lock body (410) defines a chamber (412) having a first end (414) and a second end (416) opposite to the first end (414). The lock body (410) is preferably metallic (e.g., hardened steel) to provide resistance to cutting and deformation; however, certain applications may allow the lock body (410) to be constructed from plastic or other non-metallic materials.

The example lock body (410) includes a cap (418) that engages (e.g., is welded to) an end (420) of a cylindrical housing (422). In other constructions the cap (418) may be integrally formed with the balance of the cylindrical housing (422). The cap (418) includes an opening (424) allowing access into a cavity (426) that is defined within the cap (418). The cap (418) further includes an annular lip (428) formed about a periphery of the cap (418) that is configured to selectively engage with the example key assembly (1500) to allow installation and removal of the lock assembly (400). In some embodiments, the lock assembly (400) may include one or more seals (e.g., o-rings) located adjacent openings and couplings to inhibit environmental contaminants (e.g., moisture, dirt, insects, and the like) from degrading the operation and/or continued performance of the lock assembly (400). The cap (418) is also preferably metallic and similarly resistant to tampering. Furthermore, tampering with the internal operation of the example lock assembly (400) is inhibited as no key opening is present in the cap (418), which would allow access to the internal lock components.

Figure 17:
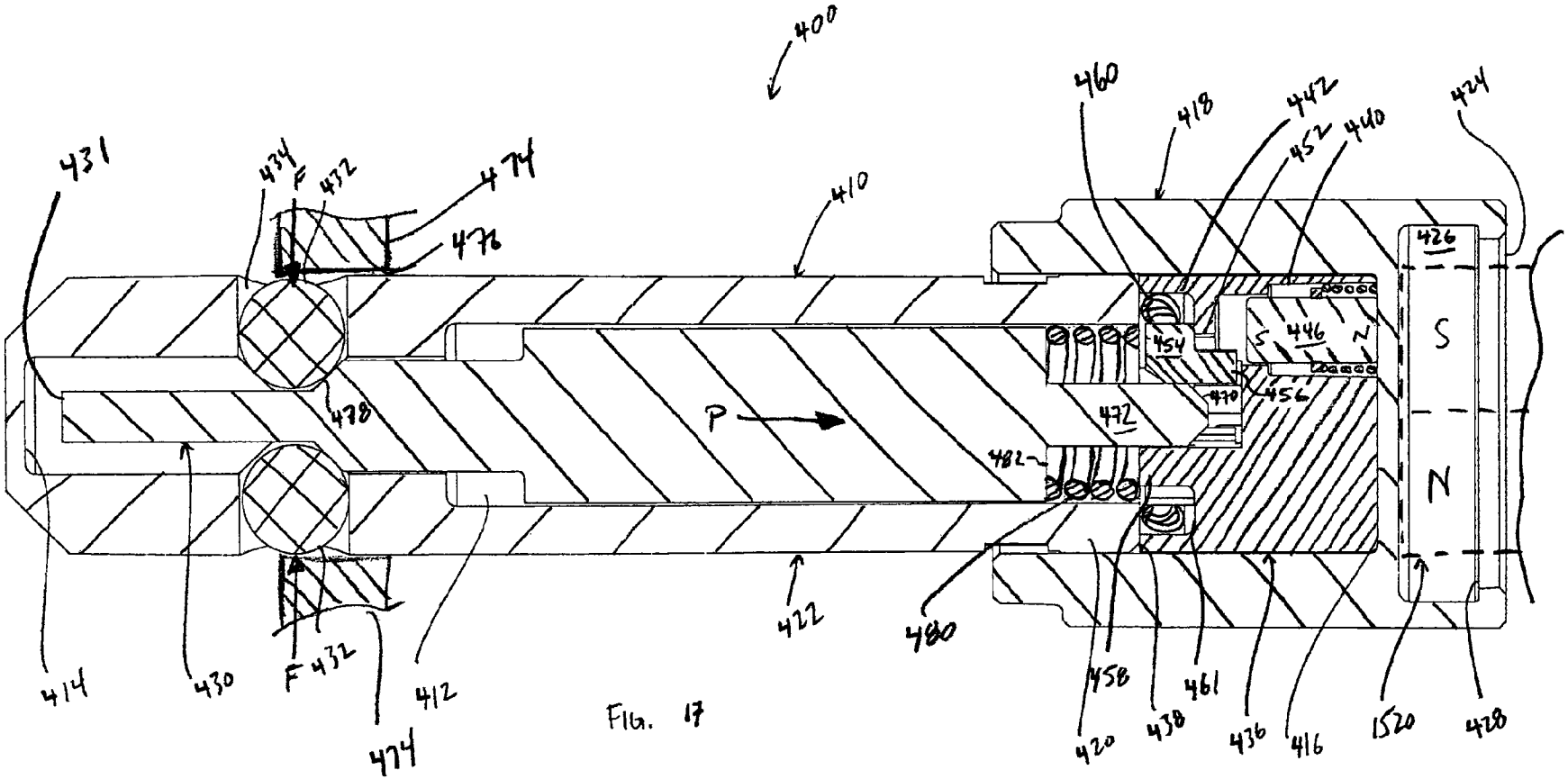
FIG. 17 is a section view of the example magnetic lock assembly shown in FIG. 9 illustrating the example transverse member in a disengaged position.

A plunger (430) is located within the chamber (412) such that the example plunger (430) can be moved axially along a longitudinal axis (A) (only annotated in FIG. 9) between a locked position (shown in FIG. 9) and an unlocked position (shown in FIG. 17). In the locked position, an end (431) of the plunger (430) abuts the first end (414) of the chamber (412), shown for example in FIG. 9. The plunger (430) is generally cylindrical to provide a compatible form factor with the cylindrically shaped chamber (412) formed by the lock body (410). The lock body (410), the chamber (412), and the plunger (430) may be configured with alternative similar or distinct form factors (e.g., oval, rhomboidal, etc. when viewed in transverse cross-section) provided the plunger (430) is capable of operation within the chamber (412), that is, the plunger (430) can move between the locked and unlocked positions during operation of the lock assembly (400). Furthermore, the plunger (430) is preferably metallic to provide sufficient robustness; again, however, when application requirements allow, the plunger (430) may be constructed, in part, from plastic or any other suitable non-metallic material(s) (e.g., composites), provided the plunger (430) is sufficiently robust to accommodate the application requirements.

Figure 10:
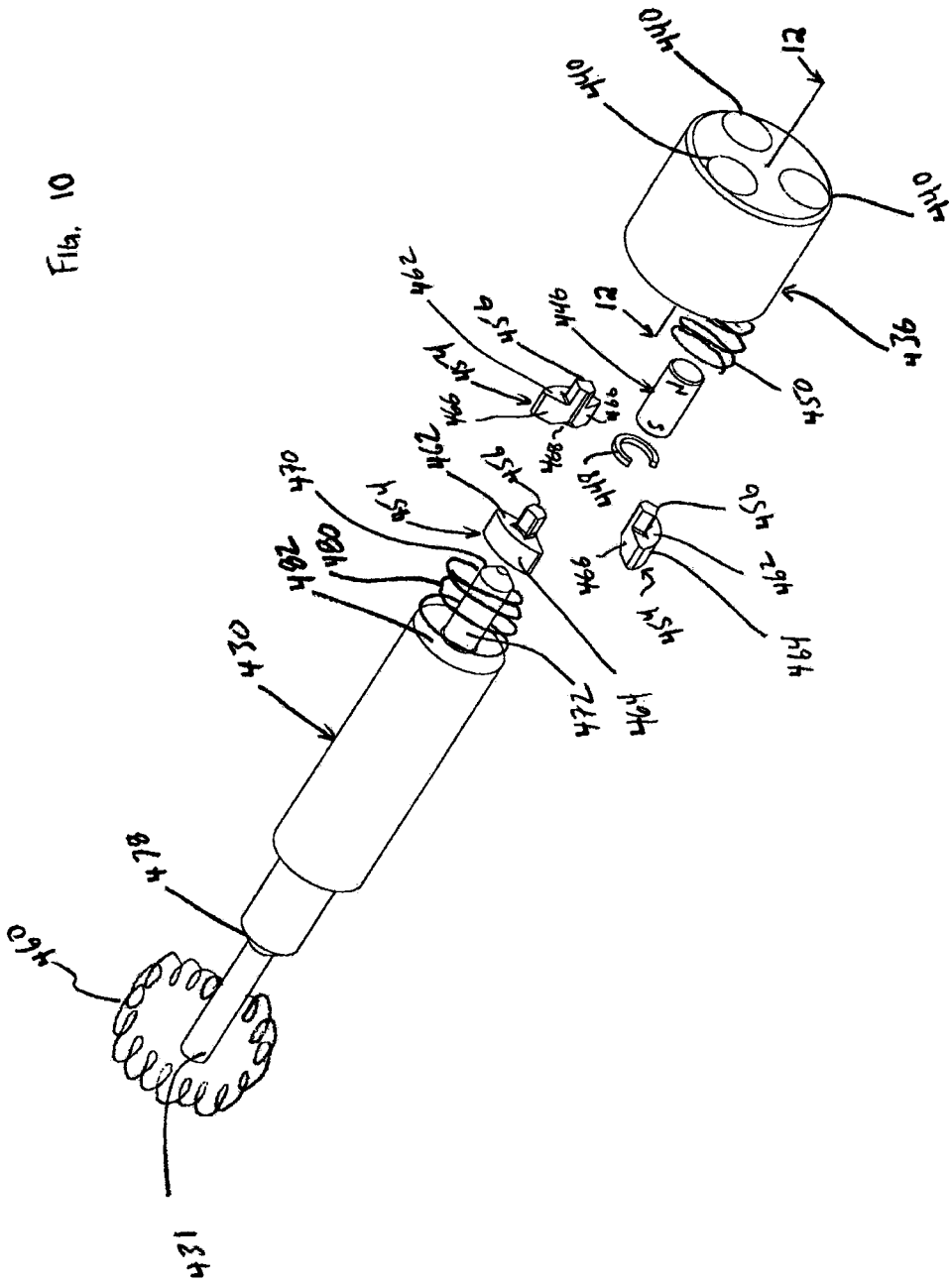
FIG. 10 is an exploded, isometric view of a portion of the example magnetic lock assembly shown in FIG. 9.
Figure 11:
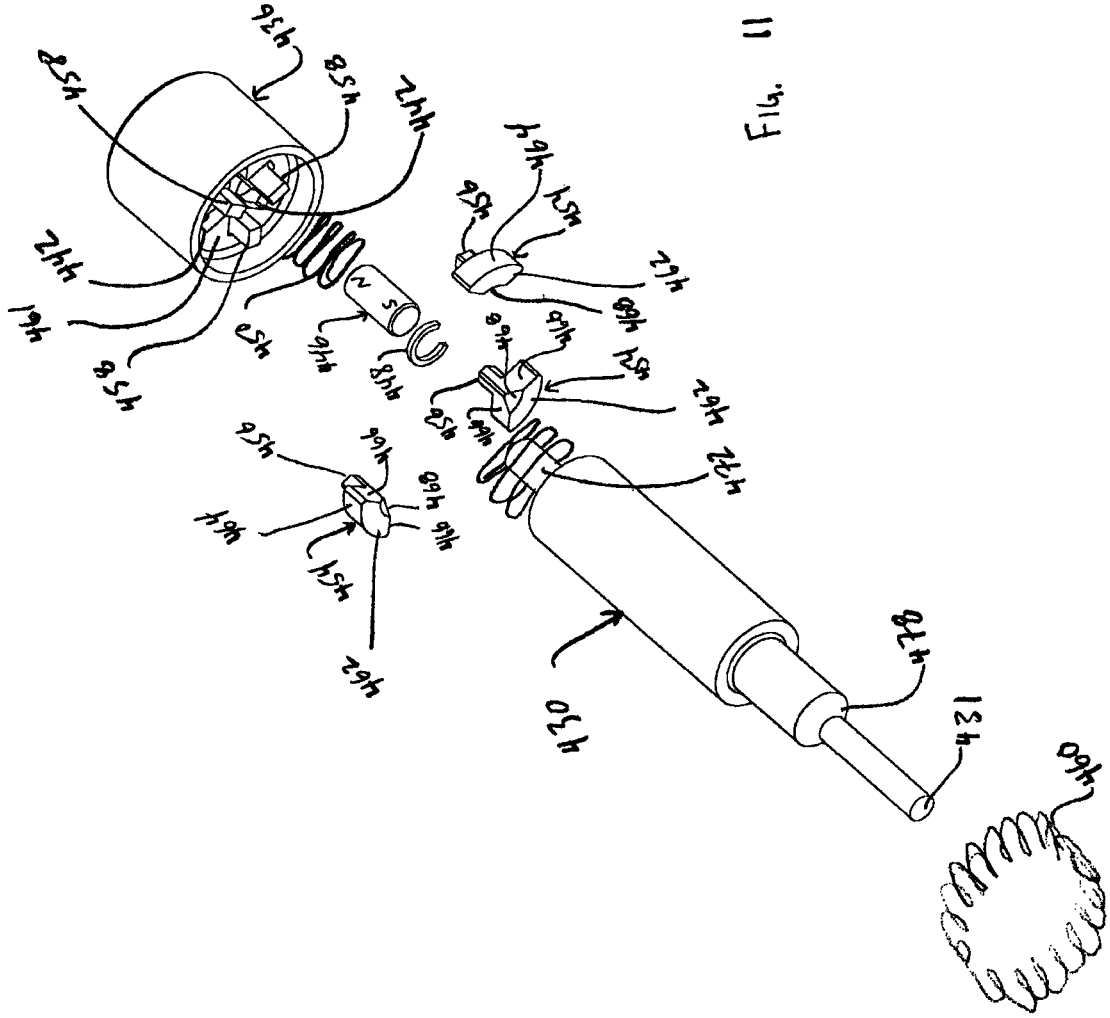
FIG. 11 is another exploded, isometric view of the portion of the example magnetic lock assembly shown in FIG. 10.
Figure 12:
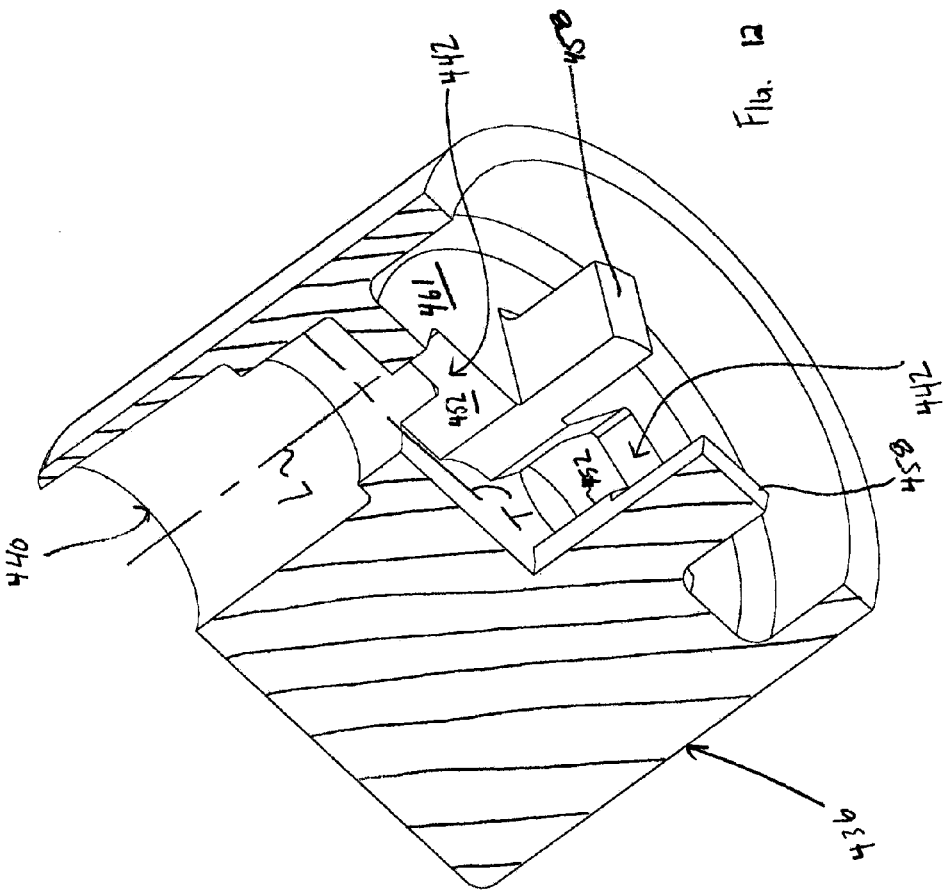
FIG. 12 is a section view along line 12-12 of FIG. 10.

With additional reference to FIGS. 10 and 11, the example embodiment of the plunger (430) is configured to engage a pair of detents in the form of balls (432). The balls (432) are captured in a lateral passage (434) that is formed through the lock body (410) and that intersects with the chamber (412). The detent(s) may include pins, blocks, and the like, and be incorporated as understood by one of ordinary skill in the art. When the lock assembly (400) is locked, that is, the plunger (430) is restrained in the locked position (shown in FIG. 9), the plunger (430) inhibits the balls (432) from retracting inward into the lock body (410), because a radially inward force on the balls (432) is counteracted by the fixed plunger (430). Conversely, when the lock assembly (400) is unlocked, that is, when the plunger (430) is allowed to move toward the unlocked position (shown in FIG. 17), the balls (432) may be configured to fully retract into the lock body (410) toward the plunger (430) from the extended position. Thus, a radially inward force applied to the balls (432) is transferred to the plunger (430) to move the plunger (430) axially along the axis (A) when the lock assembly (400) has been unlocked by a mating key assembly (1500). When the plunger (430) returns to the locked position, the balls (432) are urged outward by engagement with the plunger (430) and extend from the lock body (410). As a result, the lock assembly (400) is inhibited from axial movement when engaged with a mating lock member, such as a panel lock for a utility access box (not shown), as is understood by one of ordinary skill in the art.

In the example embodiment, movement of the plunger (430) from the locked position to the unlocked position is restrained by components within the chamber (412). In one form, the plunger (430) is ultimately moved from the locked position to the unlocked position as a result of force applied to the detent (i.e., the example balls (432)), such as when the lock assembly (400) is being installed or uninstalled from an application. To provide the locking feature, the example embodiment incorporates longitudinal members that selectively inhibit movement of respective transverse members, which in turn inhibit movement of the plunger (430). The appropriate key assembly (1500) activates the lock assembly (400) by moving all of the longitudinal members out of blocking engagement with the respective transverse members, thus allowing the transverse members to move out of blocking engagement with the plunger (430).

With specific reference to FIGS. 9-12, an example interaction and configuration of longitudinal members and transverse members is illustrated in detail. The longitudinal members and the transverse members are supported and guided during operation in a hub (436). The hub (436), which is generally in the form of a cylinder, is seated in the chamber (412) and positioned between the second end (416) and an end face (438) of the cylindrical housing (422). The hub (436) may be formed of sintered cobalt, or any other suitable process/material given the specific application requirements.

In the example embodiment, the hub (436) defines three longitudinal guideways (440) that are circumferentially equally spaced apart, and three transverse guideways (442) that are similarly equally spaced apart and aligned with the respective longitudinal guideways (440). Each of longitudinal guideways (440) is arranged to at least partially intersect a respective, mating transverse guideway (442). The intersection of a longitudinal guideway (440) with a transverse guideway (442) allows selective interference between longitudinal members and transverse members seated respectively therein.

The longitudinal guideways (440) are generally cylindrical and, in the example embodiment, each has a stepped-wall arrangement defining an intermediate step (444) along the longitudinal guideway (440). Each longitudinal guideway (440) is configured to slidably receive a longitudinal member in the form of a cylindrically-shaped pin magnet (446) having a north pole (N) and an opposite south pole (S). The pin magnet (446) is moveable along a longitudinal axis (L) (only annotated in FIG. 12), which in the example embodiment is substantially parallel with the axis (A) of the lock body (410). The pin magnet is moveable between a block position (e.g., shown in FIG. 13) and an unblock position (e.g., shown in FIG. 15).

While only one of the pin magnets (446) (i.e., an example longitudinal member) is shown exploded from the hub (436) in FIGS. 10 and 11, each pin magnet (446) includes a retainer clip (448) that is, for example, press fit, adhered, integrally formed, etc. between the ends of the pin magnet (446). The C-shaped retainer clip (448) captures a longitudinal biasing member, shown in the form of a compression spring (450), against the second end (416) of the chamber (412), such that the compression spring (450) urges the pin magnet (446) toward the block position. The biasing force of the compression spring (450) is overcome when an appropriately configured key assembly (1500) is engaged with the lock assembly (400) and actuated, as is described below in greater detail.

The transverse guideways (442) of the example embodiment are generally pie shaped and include a rectangular channel (452) extending in a radial direction relative to the axis (A). Each transverse guideway (442) is configured to slidably receive a transverse member illustrated in the form of a disc segment (454). Three circumferentially spaced dividers (458) extend from a face (461) of the hub (436) (best shown in FIG. 12) and provide separation between adjacent disc segments (454). Each disc segment (454), best shown in FIGS. 10 and 11, includes a guide post (456) that rides within the rectangular channel (452) as the disc segment (454) moves along a transverse axis (T) (only annotated in FIG. 12) between an engaged position (e.g., shown in FIG. 9) and a disengaged position (e.g., shown in FIG. 17). The transverse axis (T), shown in the example embodiment, is oriented substantially orthogonal to the axis (A) of the lock body (410).

Each disc segment (454) includes a pair of opposed walls (462) connected along one edge by an arcuate wall (464) and along a V-shaped portion by a pair of generally planar walls (466). In the example embodiment, the disc segments (454) may comprise sintered cobalt, however, the disc segments (454) may be of other constructions/compositions. The guide post (456) extends from one of the walls (462), and the opposite wall (462) includes a dimple (468). The dimple (468) is generally in the form of a partial cone segment configured to engage the plunger (430) (described below). A transverse biasing member, in the form of a ring-shaped helical spring (460), is positioned about the outer periphery of the three disc segments (454) to bias the disc segments (454) radially inward toward the axis (A) and into respective engaged positions. Those skilled in the art, given the benefit of this disclosure, will appreciate that the transverse biasing member may take on a variety of different forms, such as an o-ring or an elastomeric band.

With continued reference to FIGS. 9-11, the dimples (468) in the disc segments (454) are configured to engage a beveled portion (470) formed near an end (472) of the plunger (430). The beveled portion (470) of the example embodiment is substantially conical such that axial movement of the plunger (430) can be utilized to engage the dimples (468) of each disc segment (454), and thus urge the disc segments (454) radially outward along the transverse guideways (442) once the pin magnets (446) have been moved out of blocking engagement.

In order to unlock the lock assembly (400), the pin magnets (446) (i.e., the example longitudinal members) are all moved from the block position (shown in FIG. 13) to the unblock position (shown in FIG. 15) by magnetic interaction with the example key assembly (1500). The key assembly (1500) is used to orient a matching key magnet near the pin magnets (446). A "matching" key magnet is one that defines the appropriate polarities required to actuate (e.g., attract) all of the pin magnets (446), thus allowing each of the disc segments (454) to slide radially outward in response to the axial movement of the plunger (430) toward the unlocked position.

Figure 13:
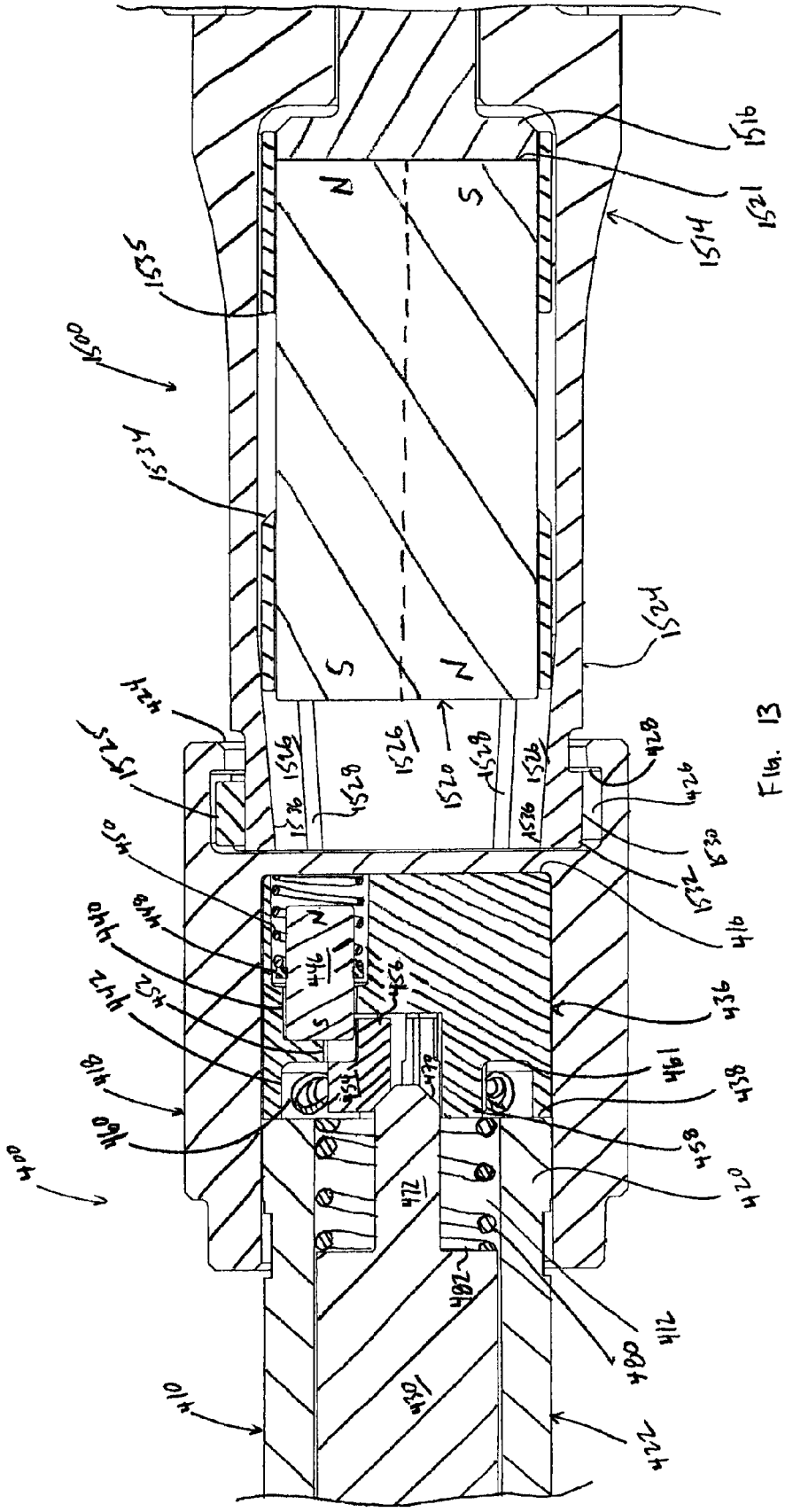
FIG. 13 is a partial, section view of the example magnetic key assembly oriented proximate to the example magnetic lock assembly shown in FIG. 8.
Figure 14:
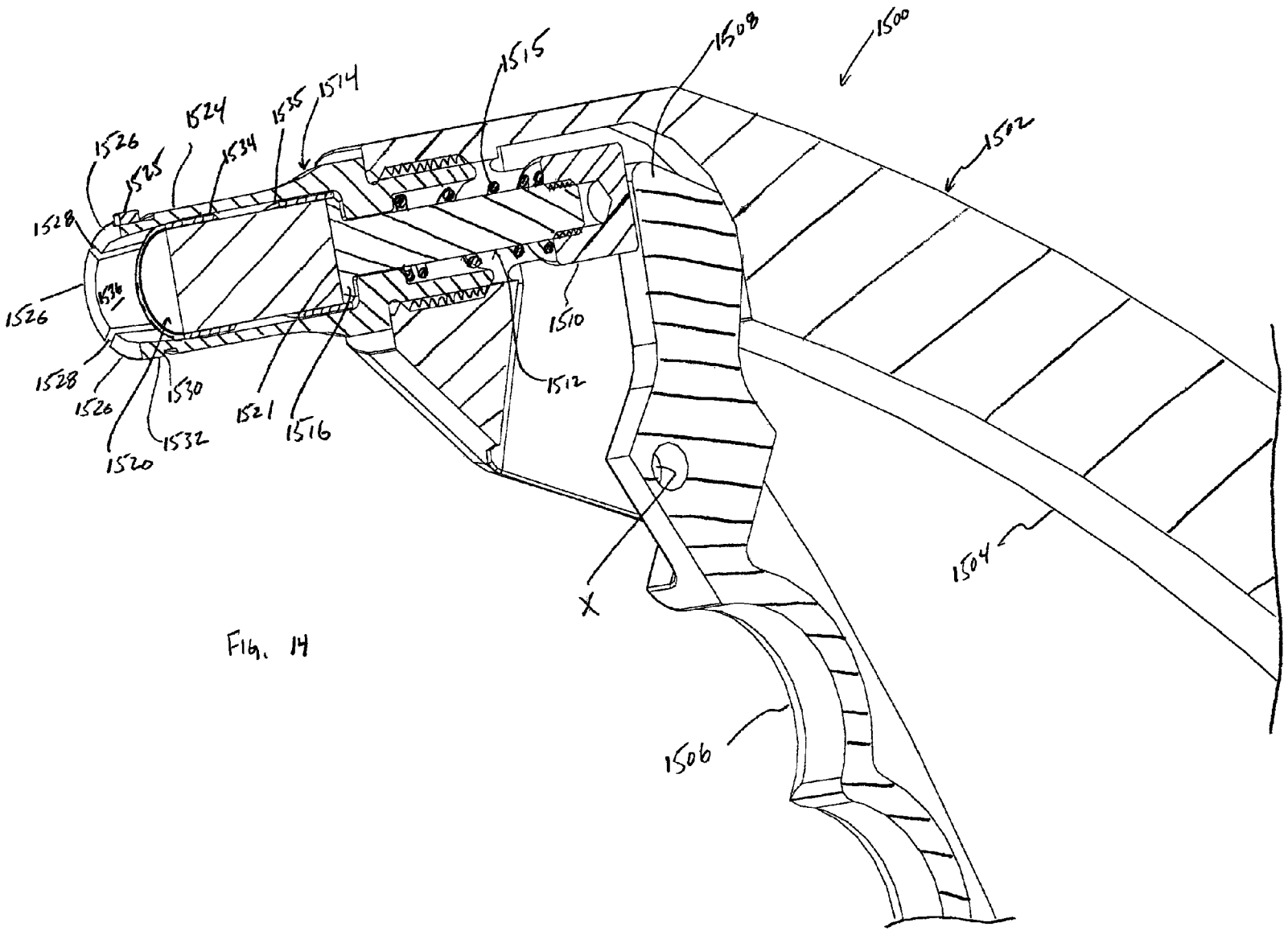
FIG. 14 is a partial, isometric section view of the example magnetic key assembly along line 14-14 of FIG. 8.

The example key assembly (1500), shown in FIGS. 8, 13, and 14, is generally in the form of a pistol-grip style that can be actuated to extend a permanent magnet to unlock the lock assembly (400). The key assembly (1500) includes a body (1502) having a grip (1504) extending from the body (1502) and a lever (1506) that is pivotally coupled to the body (1502) at pivot point (X) (e.g., by a hinge pin). The lever (1506) includes a cam portion (1508) that engages with a head (1510) formed at a first end of a rod (1512). The rod (1512) is slidably captured by a collar (1514) secured (e.g., threaded) within the body (1502) and urged by a biasing member (1515) (e.g., a compression spring) toward the cam portion (1508).

A key magnet (1520) (e.g., a permanent magnet) is engaged with a flange (1516) formed at a second end of the rod (1512). The flange (1516) is secured to an end face (1521) of the cylindrically shaped key magnet (1520) via adhesive bonding; in other forms, the key magnet (1520) may be integral with the rod (1512). In the example embodiment, the key magnet (1520) is a quad-pole magnet formed by separating a single bi-pole magnet along a longitudinal plane, rotating one half in the longitudinal plane one hundred and eighty degrees, and affixing the two halves together (e.g., via adhesive bonding). This modification results in the quad-pole key magnet (1520) illustrated in FIG. 13 having opposed ends each defining a north pole (N) and a south pole (S). Given the benefit of this disclosure, those skilled in the art will appreciate the various alternative magnet configurations that can be incorporated with the other concepts described herein such that the key magnet (1520) will actuate the desired combination of longitudinal member(s) when the key magnet (1520) is positioned near the longitudinal member(s).

The key assembly (1500) further includes a collet (1524) that extends from the collar (1514) and, in the example embodiment, generally surrounds the circumference of the key magnet (1520). The collet (1524) includes fingers (1526) that are separated by longitudinal slits (1528). Any number of fingers (1526) may be formed by respective longitudinal slits (1528) to obtain the application-specific resiliency of the fingers (1526). A shoulder (1530) is formed near a distal end (1532) of the collet (1524) and operates in combination with the fingers (1526) to selectively axially capture the key assembly (1500) and the lock assembly (400). The collet (1524), and particularly the fingers (1526), are preferably made of a resilient material (e.g., resilient plastic) such that the fingers (1526) can be slightly deformed and yet have sufficient yield strength to return to the pre-deformed shape.

During operation, engaging the key assembly (1500) with the lock assembly (400) and then actuating the key assembly (1500) will unlock the lock assembly (400), such that the plunger (430) may be moved between the locked position and the unlocked position. As shown in FIG. 13, the distal end (1532) of the collet (1524) is inserted into the opening (424) in the cap (418) positioning the shoulder (1530) of the collet (1524) adjacent to the annular lip (428) of the cap (418). With additional reference to FIG. 14, actuating the lever (1506) of the key assembly (1500) causes the cam portion (1508) to cam against the head (1510) of the rod (1512), thereby axially moving the rod (1512) toward the distal end (1532) of the collet (1524) against the urging of the biasing member (1515). As the key magnet (1520) slides in conjunction with the rod (1512), a pair of bushings (1534, 1535) (e.g., bronze bushings) secured about the key magnet (1520) engage an inwardly tapered portion (1536) of each finger (1526). Fully extending the key magnet (1520) flares the fingers (1526) radially outward such that the shoulder (1530) of the collet (1524) captures the annular lip (428) of the cap (418). As a result, the lock assembly (400) and the key assembly (1500) are axially coupled such that the key assembly (1500) can transfer a force to the lock assembly (400), such as during installation or removal of the lock assembly (400).

Actuating the key assembly (1500) positions the matching key magnet (1520) near the pin magnets (446). The key magnet (1520) then magnetically attracts each of the pin magnets (446) against the bias of the respective spring (450) to urge the pin magnets (446) from the block position (shown in FIGS. 9 and 13) to the unblock position (shown in FIGS. 15-17). The key magnet (1520) of the key assembly (1500) is shown simplified in FIGS. 15-17 with dashed lines.

The "matching" quad-pole key magnet (1520) of the example embodiment is oriented to magnetically attract all three of the pin magnets (446) seated in the hub (436). Specifically, two of the three pin magnets (446) are oriented with a south pole adjacent to the second end (416) of the chamber (412), and the third pin magnet (446) is oriented with a north pole adjacent to the second end (416) of the chamber (412). As a result, when the key magnet (1520) is oriented correctly, the two south-pole oriented pin magnets (446) are attracted to the north pole of the key magnet (1520) while the single north-pole oriented pin magnet (446) is attracted to the south pole of the key magnet (1520). An incorrect orientation between the key magnet (1520) and the pin magnets (446) results in at least one of the pin magnets (446) being magnetically repelled from the key magnet (1520) into the block position. The repelled pin magnet (446) inhibits radial movement of the respective disc segment (454) and hence axial movement of the plunger (430). Those skilled in the art, given the benefit of this disclosure, will appreciate that other combinations and configurations of longitudinal member(s), transverse member(s), and key magnet(s) may be used depending upon the specific application requirements. The use of three pin magnets (446) and a quad-pole key magnet (1520) are for illustrative purposes only.

Figure 15:
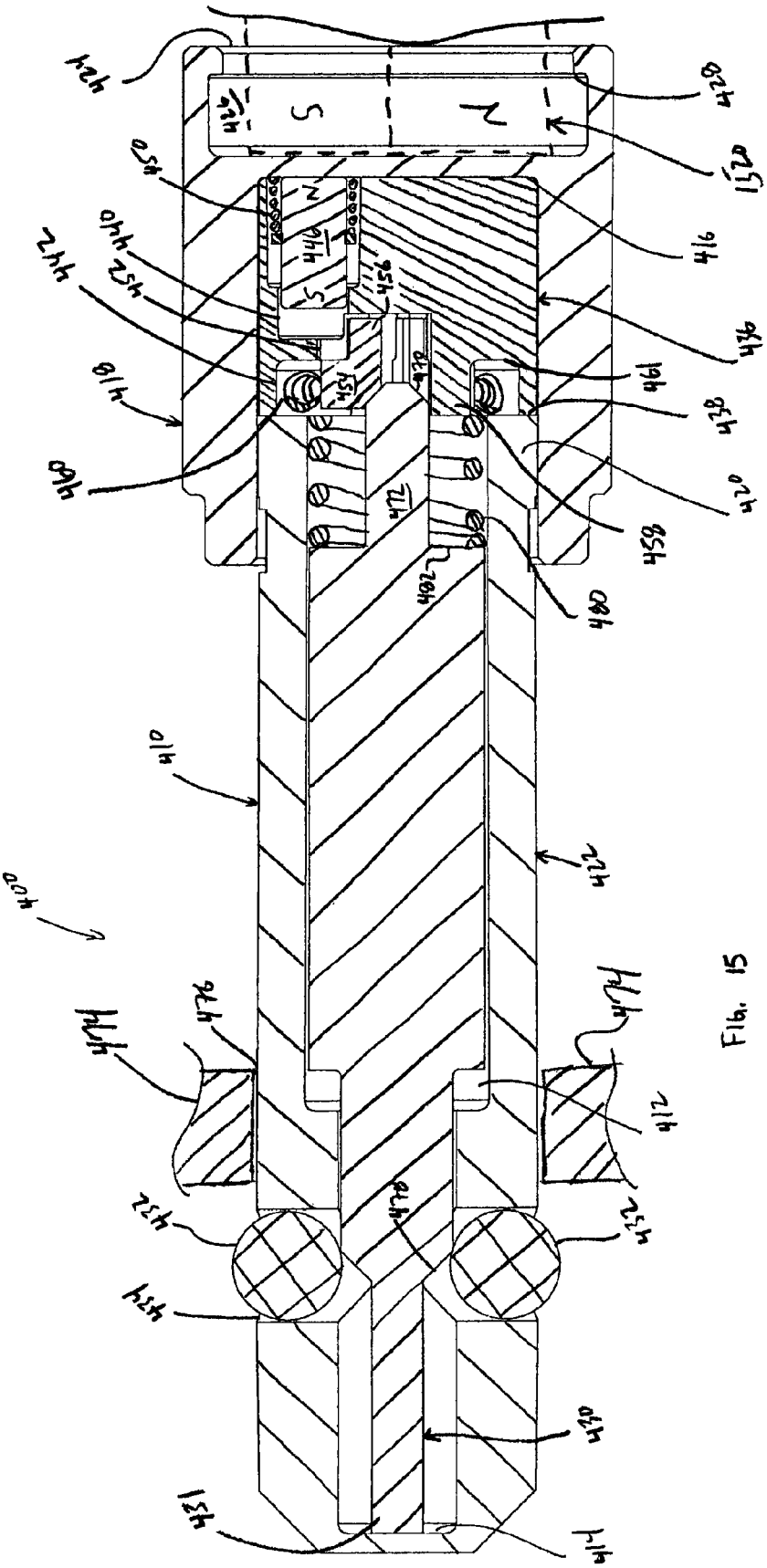
FIG. 15 is a section view of the example magnetic lock assembly shown in FIG. 9 illustrating the example longitudinal member in an unblock position.
Figure 16:
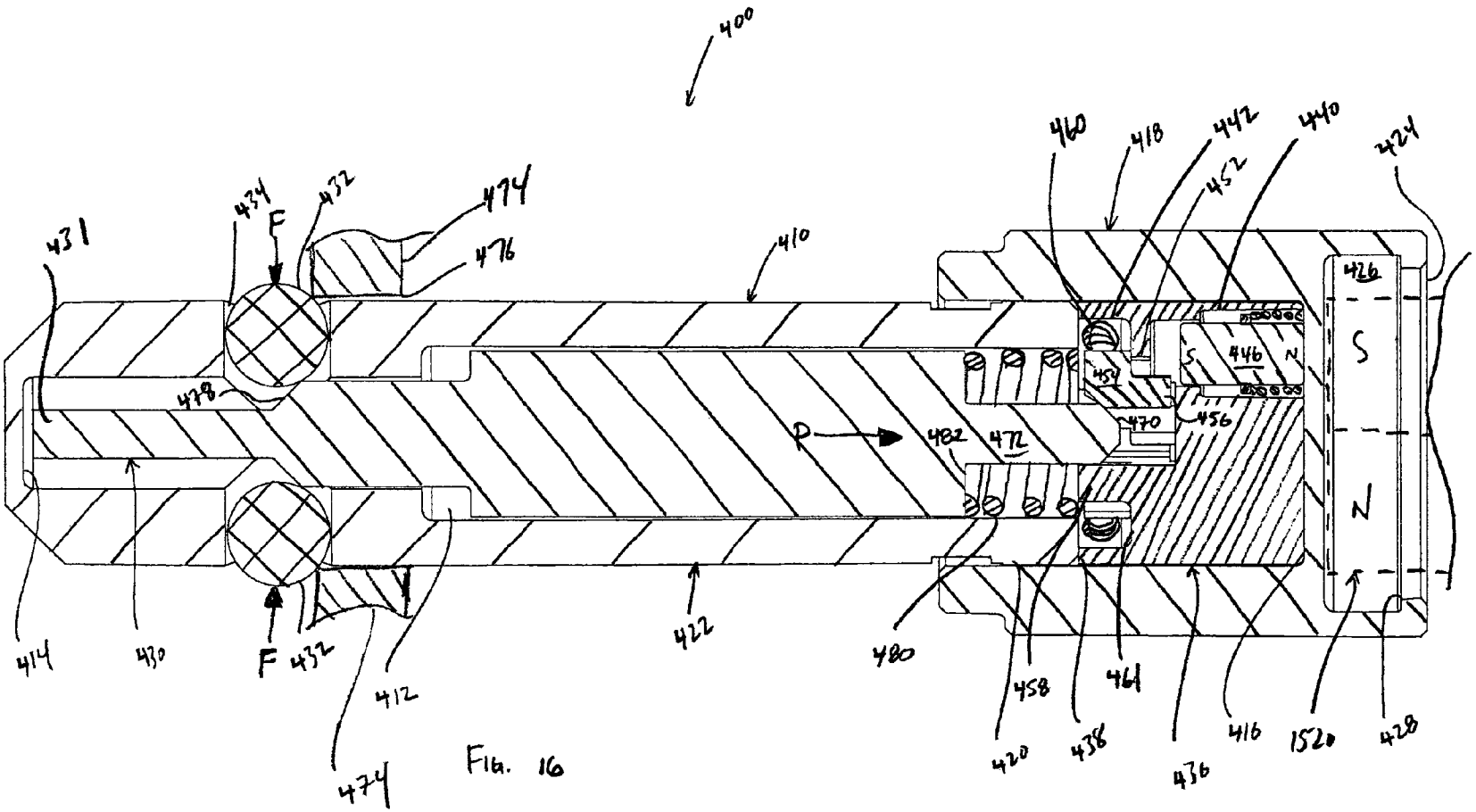
FIG. 16 is a section view of the example magnetic lock assembly shown in FIG. 9.

As shown in FIGS. 15-17, the south pole of the key magnet (1520) is oriented near the north pole of the illustrated pin magnet (446), thus urging the pin magnet (446) into the unblock position. The collet (1524) may include a protrusion (1525) that helps orient the key assembly (1500) into the predefined orientation to effectively attract each of the pin magnets (446) substantially simultaneously. Additionally, or alternatively, a mechanical interlock implemented via mating form factors between the key magnet (1520) and the cavity (426) may be implemented to further limit the positioning of the key magnet (1520), and thus the ability of a generic magnet to actuate each pin magnet (446) to unlock the lock assembly (400).

With each of the pin magnets (446) (i.e., example longitudinal members) moved from the block position into the unblock position, each of the respective disc segments (454) (i.e., example transverse members) remain biased toward the engaged position by the ring-shaped spring (460). However, the disc segments (454) may be moved from the engaged position to the disengaged position by the plunger (430) as the plunger (430) is moved from the locked position to the unlocked position.

In the example embodiment, and with continued reference to FIGS. 15-17, the lock assembly (400) is shown being uninstalled from an application (e.g., an enclosure panel lock assembly). The application includes a fixed structure (474) having an opening (476) through which the balls (432) and cylindrical housing (422) may pass through if the balls (432)

are retracted (i.e., the lock assembly (400) is in the unlocked state). In one form, the force applied to install/uninstall the lock assembly (400) (e.g., the force provided by a user) results in a reaction between the rigid structure (474) and the balls (432).

As shown in FIG. 16, the structure (474) engages the balls (432) and provides radially inward forces (F) that urge the balls (432) inward into engagement with the plunger (430). Specifically, the balls (432) engage another beveled portion (478) (best shown in FIG. 11). The axially skewed interface between the balls (432) and the beveled portion (478) results in at least a portion of the force (F) urging the plunger (430) axial from the locked position toward the unlocked position. The force (P) of the plunger (430) moves the plunger (430) against the urging of a plunger biasing member, illustrated in the form of a compression spring (480), which biases the plunger (430) toward the locked position. The compression spring (480) is located about an end (472) of the plunger (430) and is captured between a landing (482) of the plunger (430) and the hub (436). The force (P) of the plunger (430) drives the beveled portion (470) at the end (472) of the plunger (430) into engagement with the dimples (468) formed in each of the disc segments (454). When the pin magnets (446) are all in the unblock position, the force (P) of the plunger (430) moves the disc segments (454) radially outward along the transverse guideways (442) (against the biasing of the spring (460)) from the engaged position (shown in FIG. 15) toward the disengaged position (shown in FIG. 17). The dimples (468) ride along the beveled portion (470) (shown in FIG. 16) until the disc segments (454) are moved into the disengaged position (shown in FIG. 17) at which the respective guide posts (456) are radially adjacent to the plunger (430).

In the example embodiment, removing the force (F) urging the detents (i.e., the example balls (432)) into the retracted position, results in the spring (480) biasing the plunger (430) back toward the locked position, such that the beveled portion (478) urges the balls (432) back toward the extended position. The spring (460) further urges the disc segments (454) radially inward toward the axis (A) such that the disc segments (454) are moved back into the engaged position. Provided the key magnet (1520) continues to orient the pin magnets (446) in the unblock position, the plunger (430) remains unlocked, but oriented in the locked position. Removing the key magnet (1520) causes the springs (450) to urge the respective pin magnets (446) from the unblock position to the block position, whereat the pin magnets (446) again inhibit movement of the disc segments (454), and thus the plunger (430). In one form, the pin magnets (446) and the disc segments (454) may include mating skewed surfaces such that the return force of the spring (450) urging the pin magnet (446) toward the block position also urges the respective disc segment (454) toward the engaged position, without the use of the separate spring (460) acting directly upon the disc segments (454).

In the example embodiment, the pin magnet (446) (i.e., an example longitudinal member) and the key magnet (1520) include at least a portion of a permanent magnet. In some forms, the permanent magnet may comprise a material having a high magnetic field to weight ratio, such as rare earth neodymium magnets. In one embodiment, the magnet is a high strength grade rare earth magnetic material such as Neodymium Iron Boron (NdFeB), GR 45. However, the longitudinal member and the key magnet need not be made entirely of a permanent magnet. For example, a portion of the longitudinal member that engages and blocks the transverse member may be made of a robust material (e.g., steel) and have a permanent magnet coupled thereto to form the balance of the longitudinal member providing additional magnetic forces.

Figure 18:
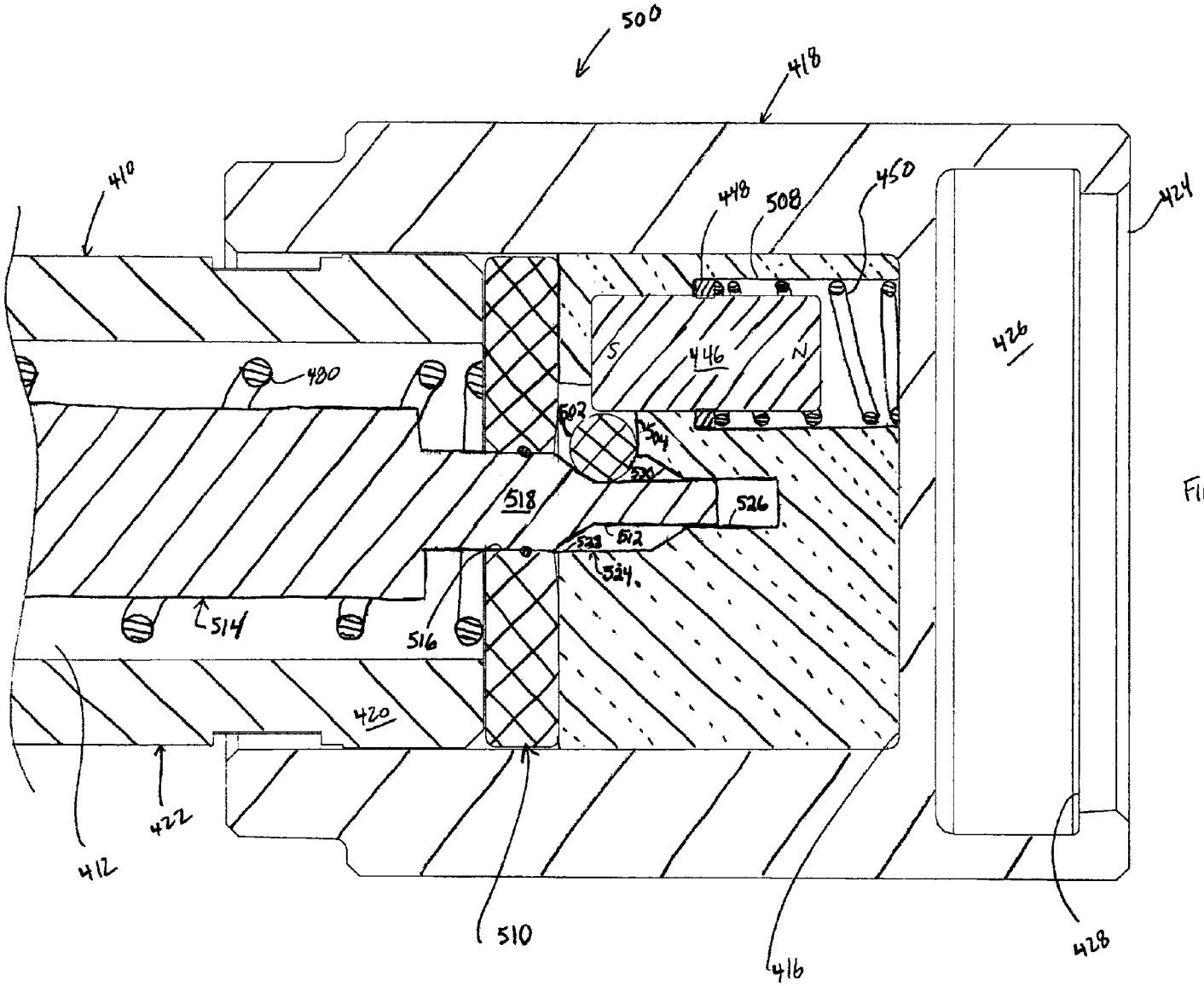
FIG. 18 is a partial section view of another example magnetic lock assembly.

An alternative example lock assembly (500) is illustrated in FIG. 18. Similar elements to those described in connection with the lock assembly (400) are identified with identical reference numerals, and description of those similar elements is not duplicated. The alternative lock assembly (500) includes transverse members in the form of spheres (502) (e.g., ball bearings). Similar to the disc segments (454), each sphere (502) is moveable along a transverse guideway (504) between an engaged position (shown in FIG. 18) and a disengaged position, when the pin magnet (446) is moved from the block position (shown in FIG. 18) to the unblock position due to the attractive forces of a key magnet (not shown). A cylindrical hub (506) defines the transverse guideways (504) and the longitudinal guideways (508). However, the hub (506) is seated between the second end (416) of the chamber (412) and a circular disc (510) positioned directly adjacent to the end face (438) of the cylindrical housing (422).

The hub (506) and the circular disc (510) are configured to receive an end portion (512) of a plunger (514). Specifically, the disc (510) includes a circular opening (516) through which a cylindrical portion (518) of the plunger (514) rides along as the plunger (514) is moved between the locked position (shown in FIG. 18) and the unlocked position. An interior groove (520) is formed within the opening (516) and receives a seal in the form of an o-ring (522). The hub (506) defines a recess (524) that is configured to receive the end portion (512) of the plunger (514). The recess (524) includes a tip-end cylindrical portion (526), a base-end cylindrical portion (528), and an intermediate beveled portion (530), which cooperate to allow the end portion (512) of the plunger (514) to slide within the recess (524) between the locked position and the unlocked position.

During operation, a force applied to the detents (not shown) can urge the plunger (514) toward the unlocked position. As the plunger (514) attempts to move toward the unlocked position, the intermediate beveled portion (530) of the plunger (514) will engage the sphere (502) and urge the sphere (502) radially outward along the transverse guideway (504). As with the first embodiment of the lock assembly (400), the pin magnets (446) will inhibit movement of the spheres (502) when the pin magnets (446) are in the block position (shown in FIG. 18). If the example pin magnets (446) have been moved to the unblock position, the urging of the plunger (514) on the spheres (502) will result in the spheres (502) moving from the engaged position to the disengaged position, thereby allowing the plunger (514) to move from the locked position to the unlocked position. The pin magnet (446) is configured to engage the sphere (502) such that the pin magnet (446) (and the biasing force provided by the spring (450)) will urge the sphere (502) toward the engaged position when the attractive force of the key magnet is no longer acting upon the pin magnet (446).

As those skilled in the art will appreciate, how "near" the key magnet (1520) and the example pin magnet (446) must be in order to move the pin magnet (446) is dependent upon a variety of variables, including, the magnetic field strength of the key magnet (1520) and pin magnet (446), the material composition and form factor of the cap (418), the biasing force provided by the longitudinal biasing member, and any intermediate gap (e.g., an air gap), for instance. The distance required to operate the lock assembly may be tailored to meet given application requirements, as understood by those skilled in the art in consideration of this disclosure. Moreover, those skilled in the art, given the benefit of this disclosure, will appreciate the variety of compositions and constructions suitable for use in accordance with the magnetic lock assembly and magnetic key assembly as may be dictated by specific application requirements.

Figure 19:
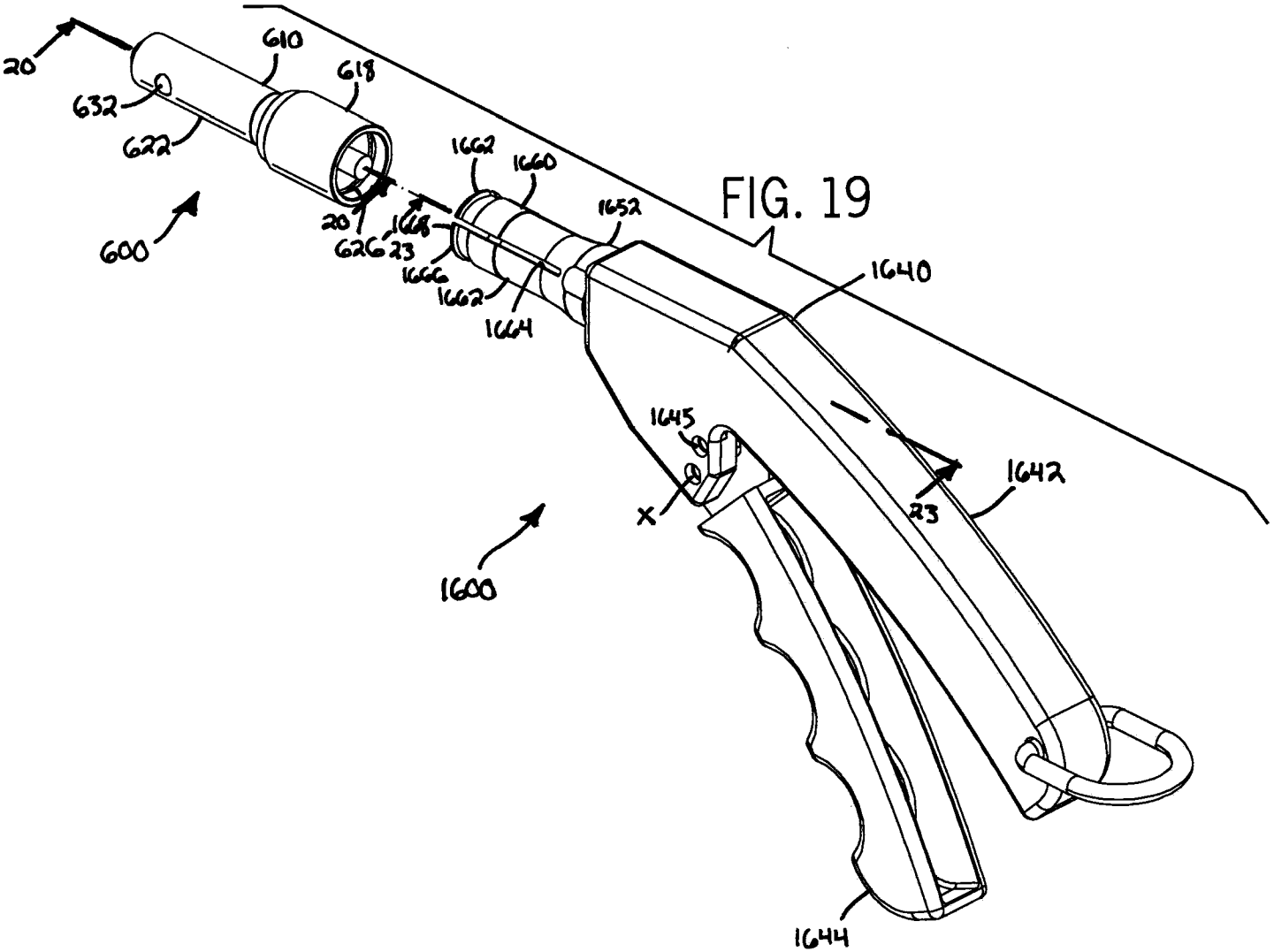
FIG. 19 is an isometric view of another example magnetic lock assembly and another example magnetic key assembly.

Another example magnetic lock assembly is shown in FIG. 19 in the form of a magnetic barrel lock assembly (600) ("lock assembly (600)"). In addition, an example magnetic key assembly is illustrated in FIG. 19 in the form of a pistol-grip style magnetic key assembly (1600) ("key assembly (1600)").

Figure 20:
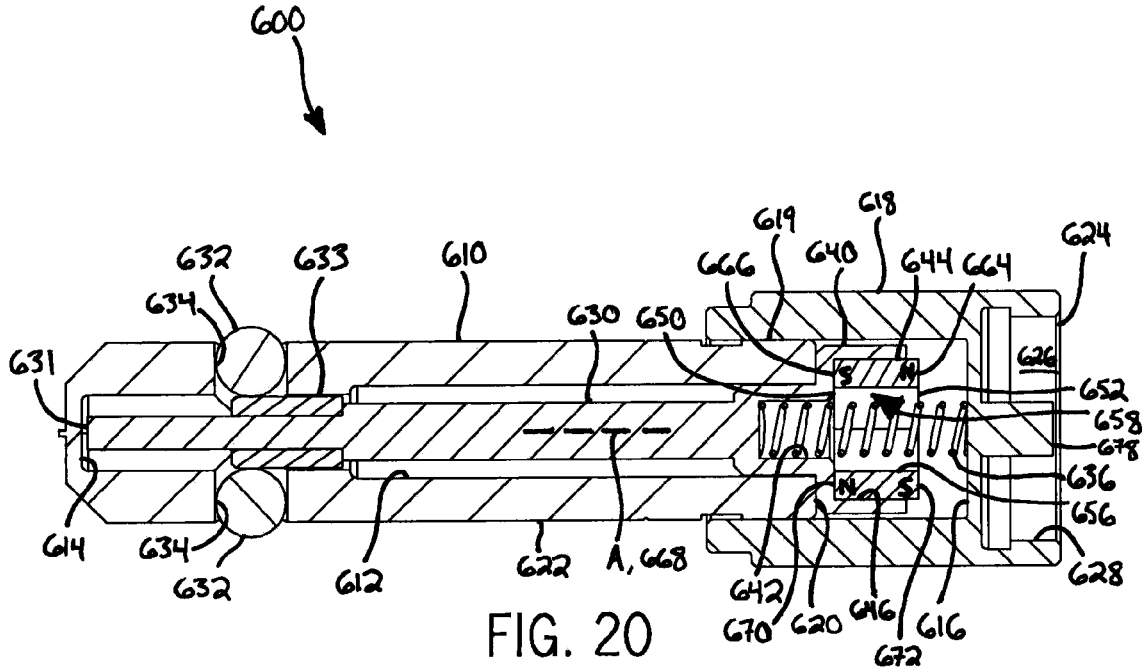
FIG. 20 is a section view of the example magnetic lock assembly along line 20-20 of FIG. 19 illustrating a plunger in a locked position.
Figure 21:
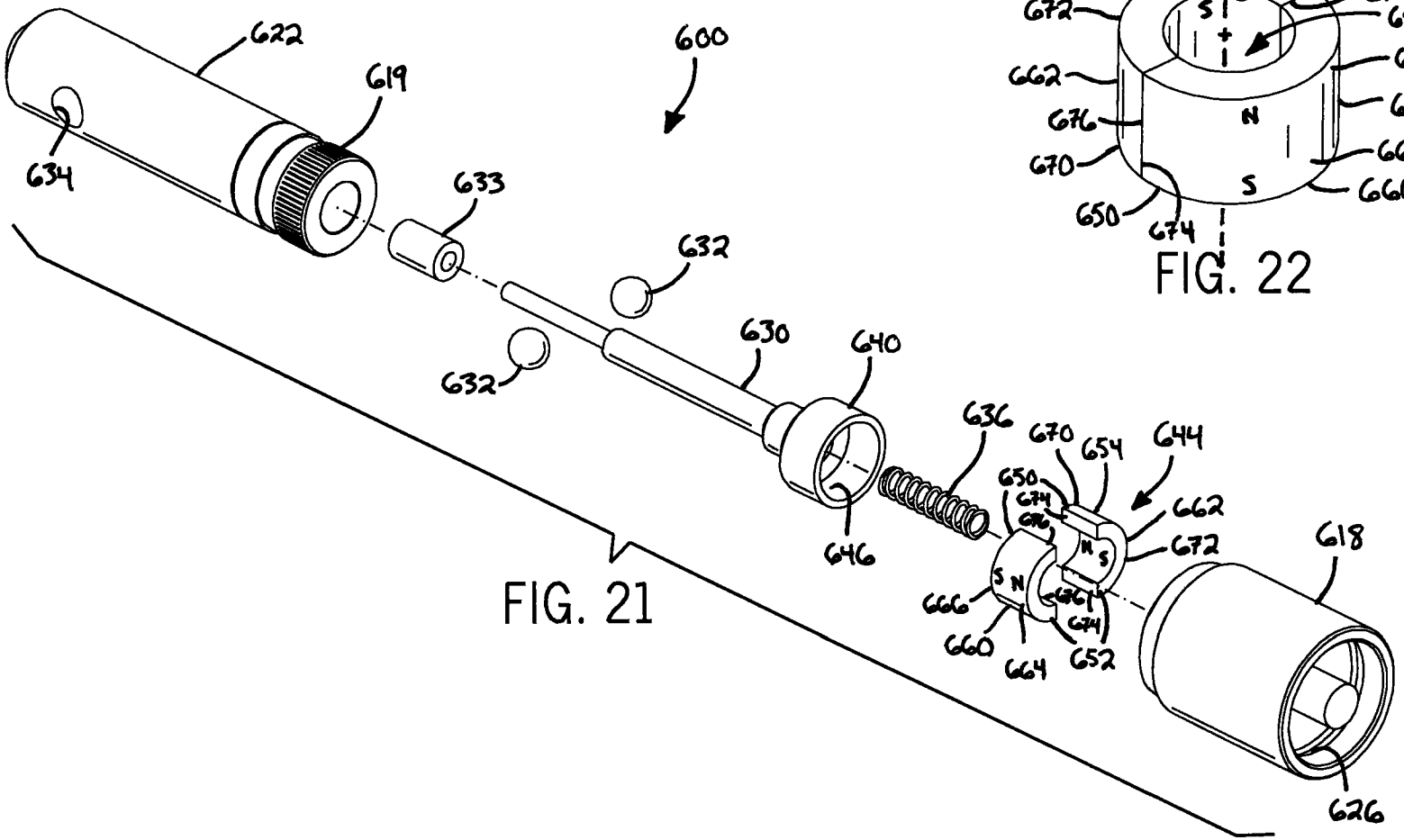
FIG. 21 is an exploded, isometric view of the example magnetic lock assembly shown in FIG. 19.

In the example configuration, and with additional reference to FIGS. 20 and 21, the lock assembly (600) includes a lock body (610) having a generally cylindrical form factor. The lock body (610) defines a chamber (612) having a first end (614) and a second end (616) opposite to the first end (614). The lock body (610) is preferably metallic (e.g., hardened steel) to provide resistance to cutting and deformation; however, certain applications may allow the lock body (610) to be constructed from plastic or other non-metallic materials.

The example lock body (610) includes a cap (618) that engages (e.g., connects via a spline interface (619) and/or is welded to) an end (620) of a cylindrical housing (622). In other constructions the cap (618) may be integrally formed with the balance of the cylindrical housing (622). The cap (618) includes an opening (624) allowing access into a cavity (626) that is defined within the cap (618). The cap (618) further includes an annular lip (628) formed about a periphery of the cap (618) that is configured to selectively engage with the example key assembly (1600) to allow installation and removal of the lock assembly (600). In some embodiments, the lock assembly (600) may include one or more seals (e.g., o-rings) located adjacent openings and couplings to inhibit environmental contaminants (e.g., moisture, dirt, insects, and the like) from degrading the operation and/or continued performance of the lock assembly (600). The cap (618) is also preferably metallic and similarly resistant to tampering. Furthermore, tampering with the internal operation of the example lock assembly (600) is inhibited as no key opening is present in the cap (618), which would allow access to the internal lock components.

Figure 28:
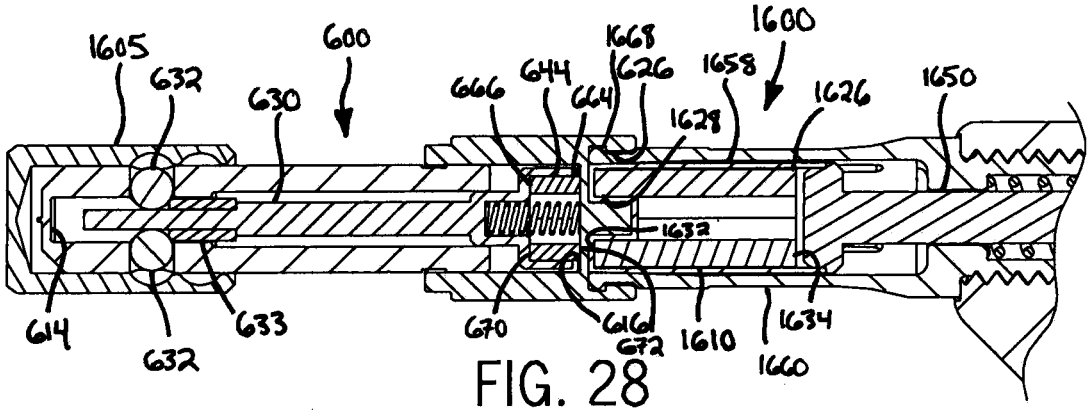
FIG. 28 is a section view of the example magnetic lock assembly shown in FIG. 19 illustrating the plunger in an unlocked position due to actuating the example magnetic key assembly.

A plunger (630) is located within the chamber (612) such that the example plunger (630) can be moved axially along a longitudinal axis (A) (only annotated in FIG. 20) between a locked position (shown in FIG. 20) and an unlocked position (shown in FIG. 28). In the locked position, an end (631) of the plunger (630) is adjacent to the first end (614) of the chamber (612). The plunger (630) is generally cylindrical to provide a compatible form factor with the cylindrically shaped chamber (612) formed by the lock body (610). The lock body (610), the chamber (612), and the plunger (630) may be configured with alternative similar or distinct form factors (e.g., oval, rhomboidal, etc. when viewed in transverse cross-section) provided the plunger (630) is capable of operation within the chamber (612); that is, the plunger (630) can move between the locked and unlocked positions during operation of the lock assembly (600). Furthermore, the plunger (630) is preferably aluminum to provide a relatively low-weight component. This inhibits movement of the plunger (630) away from the locked position in response to sudden movement of the lock body (610) (e.g., caused by striking the lock body (610) with a hammer). However, when application requirements allow, the plunger (630) may be constructed, in part, from other metals, plastics, composites, or any other suitable materials, provided the plunger (630) is sufficiently robust to accommodate the application requirements.

The plunger (630) supports an annular sleeve (633) proximate the first end (614) of the chamber (612). The annular sleeve (633) may connect to the plunger (630) in various manners, such as via press fit, adhesive bonding, or the like. Furthermore, the annular sleeve (633) is preferably hardened steel to resist deformation due to contact with an adjacent pair of detents. In some configurations and when application requirements allow, the annular sleeve (633) may be the same material as the plunger (630) and integrally connects to the plunger (630) as described in the above configurations. In either case, the sleeve (633) engages the pair of detents, which are in the form of balls (632). The balls (632) are captured in a lateral passage (634) that is formed through the lock body (610) and that intersects with the chamber (612). The detent (s) may include pins, blocks, and the like, and be incorporated as understood by one of ordinary skill in the art. When the lock assembly (600) is locked, that is, the plunger (630) is restrained in the locked position (shown in FIG. 20), the annular sleeve (633) and the plunger (630) inhibit the balls (632) from retracting inward into the lock body (610) because a radially inward force on the balls (632) is counteracted by the annular sleeve (633) and the plunger (630). Conversely, when the lock assembly (600) is unlocked, that is, when the plunger (630) is allowed to move toward the unlocked position (shown in FIG. 28) and the annular sleeve (633) is allowed to move axially away from the balls (632), the balls (632) may be configured to fully retract into the lock body (610) toward the plunger (630) from the extended position. Thus, a radially inward force applied to the balls (632) urges the balls (632) to retract into the lock body (610) when the lock assembly (600) has been unlocked by the key assembly (1600). When the plunger (630) returns to the locked position, the balls (632) are urged outward by engagement with the annular sleeve (633) and extend from the lock body (610). As a result, the lock assembly (600) is inhibited from axial movement when engaged with a mating lock member, such as a lock cap (1605) as shown in FIGS. 27 and 28, as is understood by one of ordinary skill in the art.

The plunger (630) engages a resilient member (636) that biases the plunger (630) toward the first end (614) of the chamber (612) to maintain the lock assembly (600) in the locked position until desired. The resilient member (636) is shown as a compression spring that abuts the second end (616) of the chamber (612), extends through a head portion (640) of the plunger (630), and is received in a passageway (642) within the plunger (630). The resilient member (636) may take on a variety of other forms, such as, a spring washer or an elastomeric member. The resistance provided by the resilient member (636) (i.e., in the exemplary configuration, the spring constant) is preferably considered in conjunction with the weight of the plunger (630) and is preferably sufficient to hold the plunger (630) in the locked positioned in response to sudden movement of the lock body (610).

Figure 26:
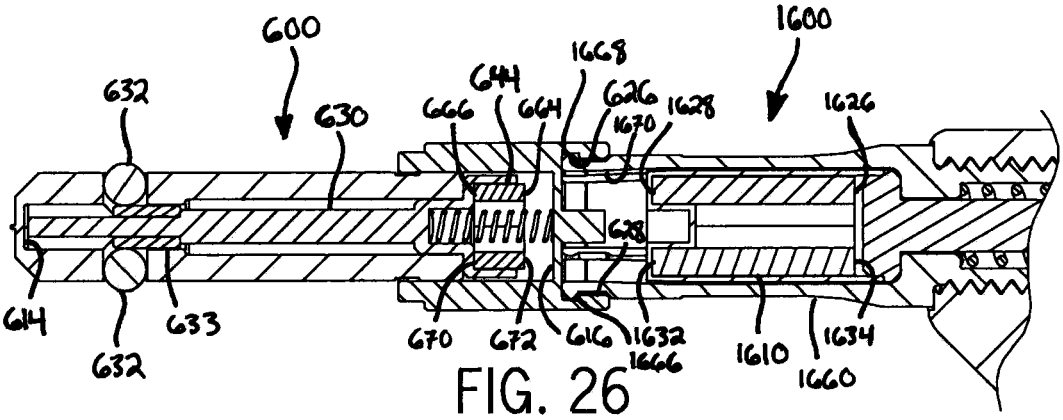
FIG. 26 is a section view of the example magnetic lock assembly shown in FIG. 19 illustrating the plunger in the locked position and prior to actuating the example magnetic key assembly.
Figure 27:
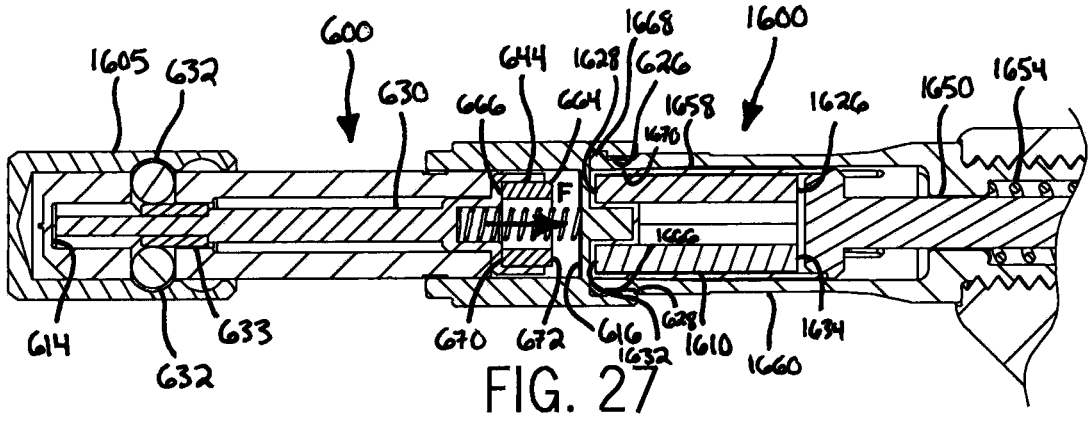
FIG. 27 is a section view of the example magnetic lock assembly shown in FIG. 19 illustrating the plunger in the locked position and upon actuating the example magnetic key assembly.

With continued reference to the example embodiment shown in FIGS. 19-21 and with additional reference to FIGS. 26-28, a lock magnet (644) is fixedly received in a recess (646) of the head portion (640) of the plunger (630) (e.g., by adhesive bonding or the like). The head portion (640) preferably contacts the lock magnet (644) over the majority of the lock magnet's (644) height (e.g., more than 75 percent of the lock magnet's (644) height) to provide a relatively large adhesive bonding surface and lateral support for the lock magnet (644).

The lock magnet (644) is also disposed proximate the second end (616) of the chamber (612). The lock magnet (644) is configured to magnetically interact with a key magnet (1610) such that when the key magnet (1610) is positioned into the key cavity (626) near the lock magnet (644), the lock magnet's polarity and the key magnet's polarity attract the lock magnet (644) toward the key magnet (1610). Therefore, positioning the key magnet (1610) within the key cavity (626) results in the lock magnet (644) being urged in the general direction of arrow F on FIG. 27. The magnetic attraction between the lock magnet (644) and the key magnet (1610) is sufficient to overcome the resistance of the resilient member (636) and thus moves the plunger (630) axially within the chamber (612). As the plunger (630) moves toward the second end (616) of the chamber (612) into the unlocked position (as shown in FIG. 28), the annular sleeve (633) moves axially away from the detent (632) such that the detent (632) may retract into the lock body (610), and the magnetic barrel lock assembly (600) may therefore be removed from a particular application. Conversely, removing the key magnet (1610) from the key cavity (626) results in the resilient member (636) biasing the plunger (630) back into the locked position, which in turn causes the detents (632) to project from the lock body (610).

As those skilled in the art will appreciate, how "near" the key magnet (1610) and lock magnet (644) must be in order to manipulate the plunger (630) is dependent upon a variety of variables, including, the magnetic field strength of the key magnet (1610) and lock magnet (644), the material composition of the cap (618), and the biasing force provided by the resilient member (636), for instance. In one configuration, the key magnet (1610) and the lock magnet (644) are positioned within one inch in order to result in the plunger (630) moving into the unlocked position. The distance required to operate the magnetic barrel lock assembly (600) may be tailored to meet given application requirements, as understood by those skilled in the art.

In preferred forms, the key magnet (1610) and the lock magnet (644) are permanent magnets made from a material having a high magnetic field to weight ratio, such as rare earth neodymium magnets. Those skilled in the art, given the benefit of this disclosure, will appreciate the variety of magnet types and compositions suitable for use in accordance with the magnetic barrel lock assembly (600) and key assembly (1600).

Figure 22:
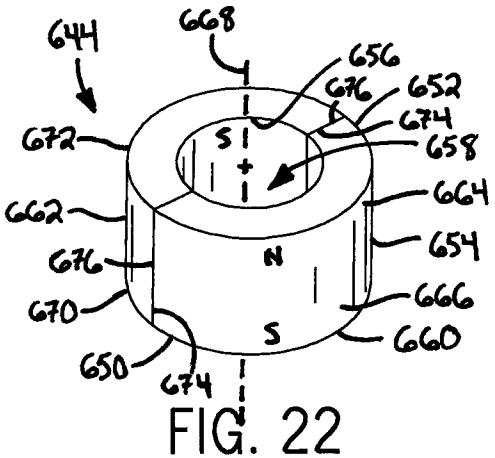
FIG. 22 is an isometric view of a lock magnet of the example magnetic lock assembly shown in FIG. 19.

With additional reference to FIGS. 20-22, in some exemplary configurations the lock magnet (644) has an annular shape including a first longitudinal axial end (650), an opposite second longitudinal axial end (652), an outer circumferential surface (654) connecting the axial ends (650) and (652), and an inner surface (656) connecting the axial ends (650) and (652) and defining an internal passageway (658). In addition, the annular shape of the lock magnet (644) is defined by multiple semi-annular lock magnet sections. In the configuration shown in the figures, the lock magnet (644) includes two semi-annular lock magnet sections (660) and (662).

The first semi-annular lock magnet section (660) defines approximately half of the overall annular shape of the lock magnet (644) (that is, the first semi-annular lock magnet section (660) defines approximately 180 degrees of an annulus). The first semi-annular lock magnet section (660) also includes a first lock magnet north pole (664) that is disposed opposite a first lock magnet south pole (666) in a longitudinal axial direction (668). The longitudinal axis (668) is preferably collinear with the longitudinal axis (A) of the plunger (630) shown in FIG. 20.

Similarly, the second semi-annular lock magnet section (662) defines approximately half of the overall annular shape of the lock magnet (644) (that is, the second semi-annular lock magnet section (662) defines approximately 180 degrees of an annulus). The second semi-annular lock magnet section (662) includes a second lock magnet north pole (670) that is disposed opposite a second lock magnet south pole (672) in the axial direction (668).

The poles (670) and (672) of the second semi-annular lock magnet section (662) are inverted in the axial direction (668) relative to those of the first semi-annular lock magnet section (660). That is, the first lock magnet north pole (664) is axially aligned with the second lock magnet south pole (672) and the first lock magnet south pole (666) is axially aligned with the second lock magnet north pole (670).

The first and second semi-annular lock magnet sections (660) and (662) engage each other along transverse surfaces (674) and (676). The first and second semi-annular lock magnet sections (660) and (662) may be fixed to each other, e.g., by adhesive bonding at the transverse surfaces (674) and (676) or the like.

Figure 23:
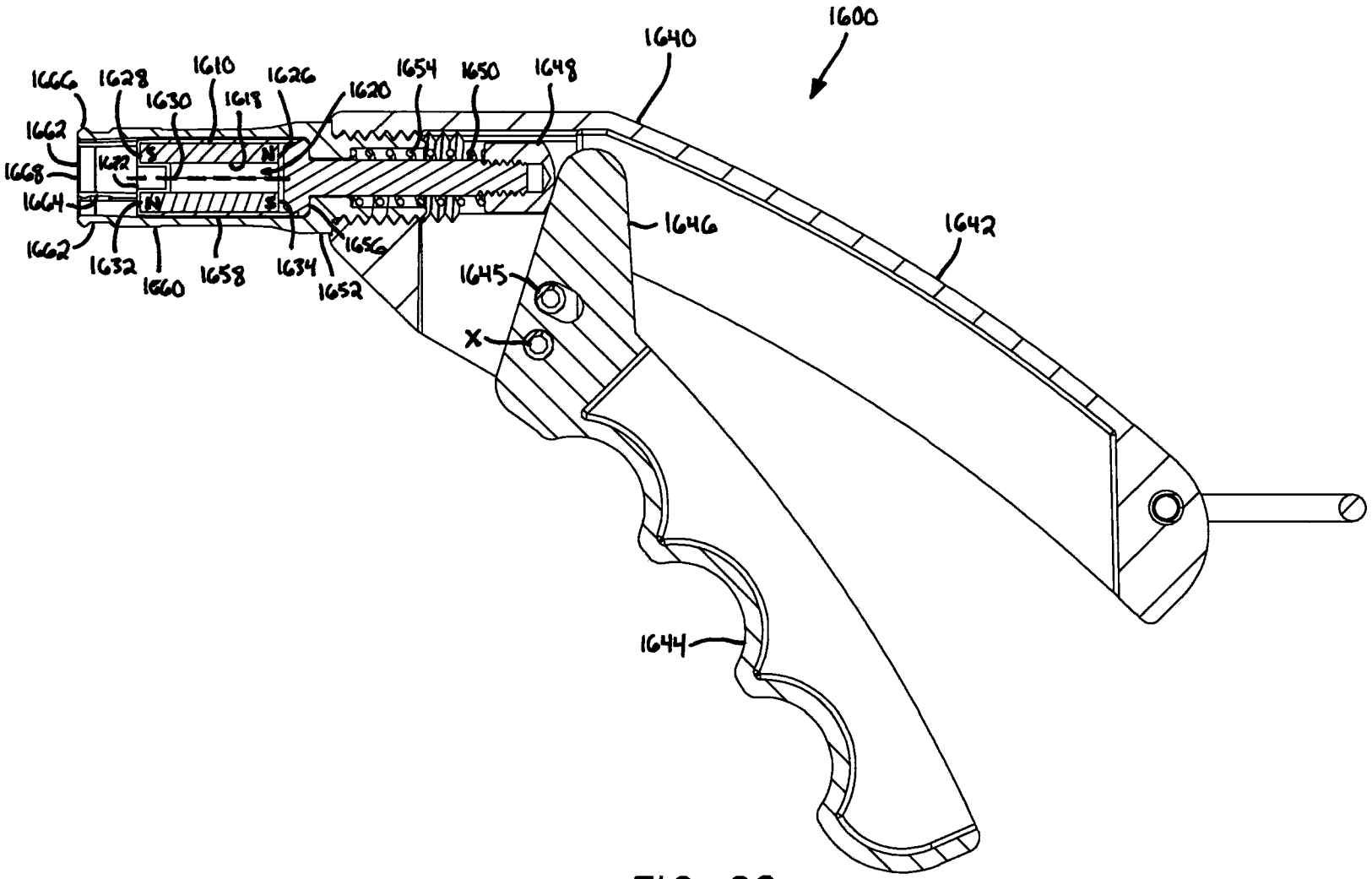
FIG. 23 is a partial, isometric section view of the example magnetic key assembly along line 23-23 of FIG. 19.
Figure 25:
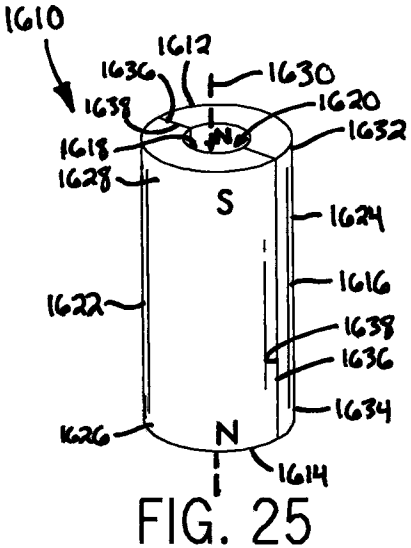
FIG. 25 is an isometric view of a key magnet of the example magnetic key assembly shown in FIG. 19.
Figure 24:
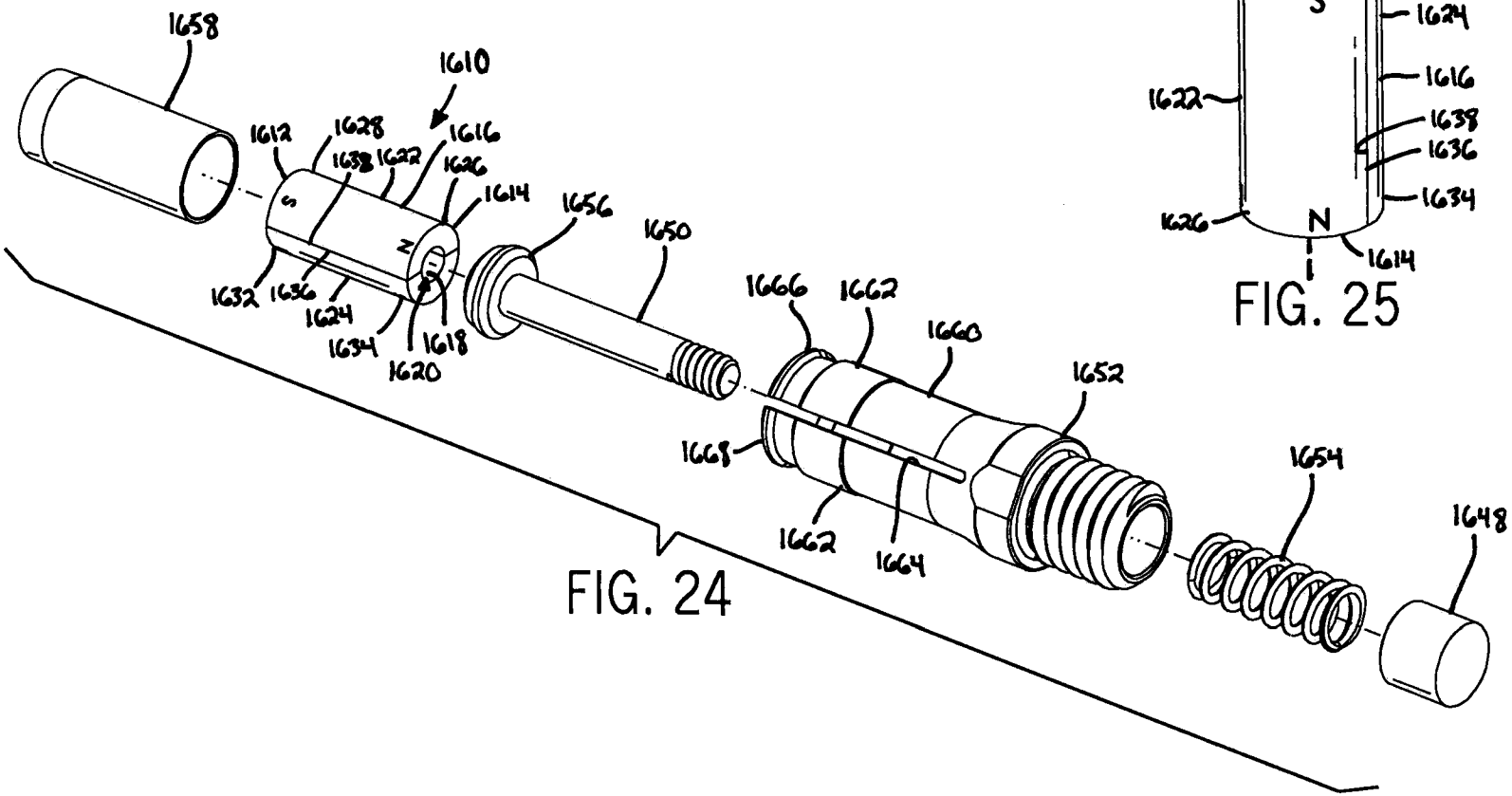
FIG. 24 is an exploded, isometric view of a portion of the example magnetic key assembly shown in FIG. 19.

With reference now to FIGS. 23-25, in some exemplary configurations the key magnet (1610) has an annular shape including a first longitudinal axial end (1612), an opposite second longitudinal axial end (1614), an outer circumferential surface (1616) connecting the axial ends (1612) and (1614), and an inner surface (1618) connecting the axial ends (1612) and (1614) and defining an internal passageway (1620). In addition, the annular shape of the key magnet (1610) is defined by multiple semi-annular lock magnet sections. In the configuration shown in the figures, the key magnet (1610) includes two semi-annular key magnet sections (1622) and (1624).

The first semi-annular key magnet section (1622) defines approximately half of the overall annular shape of the key magnet (1610) (that is, the first semi-annular key magnet section (1622) defines approximately 180 degrees of an annulus). The first semi-annular key magnet section (1622) also includes a first key magnet north pole (1626) that is disposed opposite a first key magnet south pole (1628) in a longitudinal axial direction (1630). When the key assembly (1600) is connected to the lock assembly (600), the longitudinal axis (1630) is preferably collinear with the longitudinal axis (A) of the plunger (630) and the longitudinal axis (668) of the lock magnet (644).

Similarly, the second semi-annular key magnet section (1624) defines approximately half of the overall annular shape of the key magnet (1610) (that is, the second semi-annular key magnet section (1624) defines approximately 180 degrees of an annulus). The second semi-annular key magnet section (1624) includes a second key magnet north pole (1632) that is disposed opposite a second key magnet south pole (1634) in the axial direction (1630).

The poles (1632) and (1634) of the second semi-annular key magnet section (1624) are inverted in the axial direction (1630) relative to those of the first semi-annular key magnet section (1622). That is, the first key magnet north pole (1626) is axially aligned with the second key magnet south pole (1634) and the first key magnet south pole (1628) is axially aligned with the second key magnet north pole (1632).

The first and second semi-annular key magnet sections (1622) and (1624) engage each other along transverse surfaces (1636) and (1638). The first and second semi-annular key magnet sections (1622) and (1624) may be fixed to each other, e.g., by adhesive bonding at the transverse surfaces (1636) and (1638) or the like.

With reference again to FIGS. 26-28, positioning the key magnet (1610), when oriented properly, within the key cavity (626) causes the magnetic poles to magnetically interact to ultimately urge the lock magnet (644) toward the key magnet (1610) and thus move the plunger (630) to the unlocked position. Specifically, the first lock magnet north pole (664)

magnetically interacts with the first key magnet south pole (1628) and the second lock magnet south pole (672) magnetically interacts with the second key magnet north pole (1632) to move the lock magnet (644) and the plunger (630).

Other magnets, such as common bar magnets having only two poles at opposite ends, will not move the lock magnet (644) and the plunger (630) to unlock the lock assembly (600). Using a bar magnet as an example, this occurs because one of the first lock magnet north pole (664) and the second lock magnet south pole (672) is attracted to the nearest pole of the bar magnet, although the other of the first lock magnet north pole (664) and the second lock magnet south pole (672) is repulsed from the nearest pole of the bar magnet. The attraction and repulsion forces have the same magnitude and cancel each other, and thus the lock magnet (644) does not move.

Stated another way, the lock assembly (600) has a magnetic polarity code, and only the inverse polarity code unlocks the lock assembly (600). That is, the arrangement of the poles on the key magnet (1610) defines a key magnetic polarity code or a key polarity code. At the second longitudinal axial end (1614) of the key magnet (1610), the key polarity code is S-N (as oriented as shown in FIGS. 26-28). The lock magnet (644) similarly defines a lock magnetic polarity code or a lock polarity code. At the first longitudinal axial end (650) of the lock magnet (644), the lock polarity code is N-S (as oriented as shown in FIGS. 26-28). Inserting the key magnet (1610) into the key cavity (626) and aligning, or permitting alignment of, the key magnet (1610) such that the key polarity code at the second axial end (1614) is the inverse of the lock polarity code at the first axial end (650) causes magnetic attraction between the key magnet (1610) and lock magnet (644).

Stated yet another way, the lock magnet (644) and the key magnet (1610) are magnetically attractively aligned to urge the lock magnet (644) toward the key magnet (1610). As used herein, the term "magnetically attractively aligned" means that the magnets (644) and (1610) are angularly oriented to attract each other. When magnetically attractively aligned, the magnets (644) and (1610) are movable toward each other to assume a stable position (i.e., a relatively low-energy state relative to adjacent positions) without further changing their angular orientation relative to each other. In the exemplary configurations, the magnets (644) and (1610) occupy a stable position when the first lock magnet north pole (664) is angularly aligned with the first key magnet south pole (1628) and when the second lock magnet south pole (672) is angularly aligned with the second key magnet north pole (1632). As used herein, the term "automatically" magnetically attractively aligned means that magnetic interaction between the lock magnet (644) and the key magnet (1610) magnetically attractively aligns the lock magnet (644) and the key magnet (1610) when the magnets (644) and (1610) are sufficiently near to each other. As described in further detail below, this may be facilitated by rotatably supporting one or both of the lock magnet (644) and the key magnet (1610).

The exemplary lock magnet (644) and the key magnet (1610) are also said to be magnetically matching. As used herein, "magnetically matching" means that the key magnet is one that defines the appropriate polarities needed to actuate (e.g., attract) the lock magnet (644), thus being capable of moving the plunger (630) toward the unlocked position.

The exemplary lock magnet (644) and the key magnet (1610) are also said to be magnetically corresponding. As used herein, the term "magnetically corresponding" means that two magnets have the same pole arrangements, although not necessarily the same physical dimensions or magnetic field strength properties. Moreover, when two magnetically corresponding magnets are attracted to each other, the magnets have a tendency to position themselves in the same angular orientation. For example, the first semi-annular lock magnet section (660) and first semi-annular key magnet section (1622) have a tendency to angularly align with each other about their longitudinal axes (668) and (1630).

The example key assembly (1600), shown in FIGS. 19, 23, and 24, is generally in the form of a pistol-grip style that can be actuated to extend the key magnet (1610) to unlock the lock assembly (600). The key assembly (1600) includes a body (1640) having a grip (1642) extending from the body (1640) and a lever (1644) that is pivotally coupled to the body (1640) at pivot point (X) (e.g., by a hinge pin). The pivot range of the lever (1644) relative to the body (1640) may be limited, e.g., by a pin-in-slot connection (1645). The lever (1644) includes a cam portion (1646) that engages with a head (1648) formed (e.g., threadably attached) at a first end of a rod (1650). The rod (1650) is slidably captured to a collar (1652) secured (e.g., threaded) within the body (1640) and urged by a biasing member (1654) (e.g., a compression spring) toward the cam portion (1646). The head (1648) can be adjusted (e.g., rotated) to alter the stroke or throw of the rod (1650).

A second end of the rod (1650) includes a flange (1656) that supports a generally-cylindrical carrier (1658). The carrier (1658) internally rotatably supports the key magnet (1610) (i.e., the key magnet (1610) is free to rotate within the carrier (1658) about the longitudinal axis (1630)). As such, when the rod (1650) moves the carrier (1658) and the magnet (1610) toward the lock magnet (644) as shown in FIG. 27, the key magnet (1610) rotates, due to magnetic interaction with the lock magnet (644), to facilitate automatic magnetic attractive alignment between the key magnet (1610) and the lock magnet (644). The carrier (1658) can be made of stainless steel or any other material that is suitable for the particular application requirements.

The key assembly (1600) further includes a collet (1660) that extends from the collar (1652) and, in the exemplary configuration, generally surrounds the circumference of the carrier (1658). The collet (1660) includes fingers (1662) that are separated by longitudinal slits (1664). Any number of fingers (1662) may be formed by respective longitudinal slits (1664) to obtain the application-specific resiliency of the fingers (1662). A shoulder (1666) is formed near a distal end (1668) of the collet (1660) and operates in combination with the fingers (1662) to selectively axially capture the key assembly (1600) and the lock assembly (600). The collet (1660), and particularly the fingers (1662), are preferably made of a resilient material (e.g., resilient plastic) such that the fingers (1662) can be slightly deformed and yet have sufficient yield strength to return to the pre-deformed shape.

With reference to FIGS. 26-28 and during operation, engaging the key assembly (1600) with the lock assembly (600) and then actuating the key assembly (1600) will unlock the lock assembly (600), such that the plunger (630) may be moved between the locked position and the unlocked position. As shown in FIG. 26, the distal end (1668) of the collet (1660) is inserted into the opening (624) in the cap (618) positioning the shoulder (1666) of the collet (1660) adjacent to the annular lip (628) of the cap (618). As shown in FIG. 27, actuating the lever (1644) of the key assembly (1600) causes the cam portion (1646) to cam against the head (1648) of the rod (1650), thereby axially moving the rod (1650) toward the distal end (1668) of the collet (1660) against the urging of the biasing member (1654). As the carrier (1658) and the key magnet (1610) slide in conjunction with the rod (1650), the circumference of the carrier (1658) engages an inwardly tapered portion (1670) of each finger (1662). Fully extending the carrier (1658) the key magnet (1610) flares the fingers (1662) radially outward such that the shoulder (1666) of the collet (1660) captures the annular lip (628) of the cap (618). As a result, the lock assembly (600) and the key assembly (1600) are axially coupled such that the key assembly (1600) can transfer a force to the lock assembly (600), such as during installation or removal of the lock assembly (600).

Actuating the key assembly (1600) positions the key magnet (1610) near the lock magnet (644). As the key magnet (1610) approaches the lock magnet (644), the key magnet (1610) automatically magnetically attractively aligns with the lock magnet (644) due to magnetic interaction. This attracts the lock magnet (644) toward the key magnet (1610) and thus moves the plunger (630) to the unlocked position. Alternatively and in some configurations, the key magnet (1610) may be rotatably fixed within the carrier (1658) (e.g., by adhering the key magnet (1610) within the carrier (1658) or the like) and the plunger (630) may be rotatable within the housing (622) about axis (A) (e.g., by supporting a low-friction washer, not shown, that abuts the resilient member (636) or the like) to facilitate automatic magnetic attractive alignment between the key magnet (1610) and the lock magnet (644). As another alternative configuration, the key magnet (1610) may be rotatably fixed within the carrier (1658) and the lock magnet (644) may be rotatably supported by the plunger (630) about its longitudinal axis (668) (e.g., by a bearing, not shown, supported by the plunger) to facilitate automatic magnetic attractive alignment between the key magnet (1610) and the lock magnet (644). As yet another alternative configuration, the key magnet (1610) may be rotatably supported within the carrier (1658) and the plunger (630) may be rotatable within the housing (622) about axis (A) to facilitate automatic magnetic attractive alignment between the key magnet (1610) and the lock magnet (644). As yet another alternative configuration, the key magnet (1610) may be rotatably supported within the carrier (1658) and the lock magnet (644) may be rotatably supported by the plunger (630) about the longitudinal axis (668) to facilitate automatic magnetic attractive alignment between the key magnet (1610) and the lock magnet (644).

For the exemplary lock assembly (600) and key assembly (1600), various component dimensions may be modified to provide uniquely "keyed" lock assemblies (600) that may only be unlocked by certain key assemblies (1600). In some configurations, some lock assemblies (600) may only be unlocked by one key assembly (1600). Exemplary features that facilitate mechanical "keying" include the diameter and height of an axially extending pin (678) disposed within the cavity (626) (see FIG. 20) and the diameter and depth of an axially extending recess (1672) defined by the carrier (1658) (see FIG. 23) for receiving the pin (678). Exemplary features that also facilitate keying include the diameter and depth of the cavity (626) (see FIG. 20) and the dimensions of the associated connecting features of the collet (1660).

While there has been shown and described what is at present considered the preferred example embodiments of the concepts, it will be obvious to those skilled in the art that various changes and modifications can be made, given the benefit of this disclosure, without departing from the scope defined by the following claims.

We claim:

1. A magnetic lock and key assembly, comprising:

a magnetic lock assembly including:

a lock body defining a chamber;

a plunger disposed within the chamber and being translatable in a longitudinal axial direction between a locked position and an unlocked position;

a resilient member urging the plunger toward the locked position;

a detent being extendable when the plunger is in the locked position and retractable when the plunger is in the unlocked position;

a lock magnet disposed within the chamber and being translatable with the plunger as the plunger translates between the locked position and the unlocked position, the lock magnet having an end defined by a lock magnet north pole and a lock magnet south pole;

a magnetic key assembly including:

a collet configured to connect to the lock body;

a key magnet supported within the collet, the key magnet having an end defined by a key magnet north pole and a key magnet south pole;

wherein at least one of the lock magnet is rotatably supported by the lock body and the key magnet is rotatably supported by the collet to facilitate automatic magnetic attractive alignment of the lock magnet and the key magnet about the longitudinal axial direction and magnetic attraction between the lock magnet north pole and the key magnet south pole and between the lock magnet south pole and the key magnet north pole to translate the plunger to the unlocked position.

2. The magnetic lock and key assembly of claim 1, wherein the key magnet is rotatably supported by the collet.

3. The magnetic lock and key assembly of claim 2, wherein the key assembly further includes:

a rod supported within the collet and being translatable between an actuated position and a non-actuated position; and a carrier translatably supported within the collet and rotatably housing the key magnet, the carrier being connected the rod such that the carrier and the key magnet are translatable with the rod between the actuated position and the non-actuated position.

4. The magnetic lock and key assembly of claim 1, wherein the lock magnet has an annular shape including the lock magnet north pole and the lock magnet south pole and the key magnet has an annular shape including the key magnet north pole and the key magnet south pole.

5. The magnetic lock and key assembly of claim 1, wherein the key magnet magnetically corresponds to the lock magnet.

6. A magnetic key assembly, comprising:

a collet configured to connect to a magnetic lock assembly;

a rod supported within the collet and being translatable in a longitudinal axial direction between an actuated position and a non-actuated position;

a key magnet being translatable within the collet due to movement of the rod between the actuated position and the non-actuated position, the key magnet having a longitudinal axial end opposite the rod, and the longitudinal axial end being defined by a key magnet north pole and a key magnet south pole;

wherein connecting the collet to the magnetic lock assembly and positioning the key magnet near a lock magnet of the magnetic lock assembly having an end defined by a lock magnet north pole and a lock magnet south pole automatically magnetically attractively aligns the key magnet and the lock magnet and attracts the lock magnet toward the key magnet to unlock the magnetic lock assembly.

7. The magnetic key assembly of claim 6, wherein the key magnet is rotatably supported by the rod.

8. The magnetic key assembly of claim 7, further comprising a carrier translatably supported within the collet and connected to the rod, the carrier rotatably housing the key magnet.

9. The magnetic key assembly of claim 6, wherein the key magnet has an annular shape including the longitudinal axial end and an outer circumferential surface adjacent the longitudinal axial end.

10. The magnetic key assembly of claim 9, wherein the key magnet north pole and the key magnet south pole each define substantially one-half of the longitudinal axial end.

11. The magnetic key assembly of claim 6, wherein the key magnet has an annular shape defined by a first semi-annular key magnet section connected to a second semi-annular key magnet section, the first semi-annular key magnet section including the key magnet north pole and the second semi-annular key magnet section including the key magnet south pole.

12. The magnetic key assembly of claim 11, wherein the key magnet north pole is a first key magnet north pole and the key magnet south pole is a second key magnet south pole, the first semi-annular key magnet section further including a first key magnet south pole axially opposite the first key magnet north pole, and the second semi-annular key magnet section further including a second key magnet north pole axially opposite the second key magnet south pole.

13. A magnetic lock assembly, comprising:

a lock body defining a chamber having a first end and an opposite second end;

a plunger disposed within the chamber and being translatable in a longitudinal axial direction between a locked position and an unlocked position;

a resilient member urging the plunger toward the locked position;

a detent being extendable when the plunger is in the locked position and retractable when the plunger is in the unlocked position;

a lock magnet being translatable with the plunger as the plunger moves between the locked position and the unlocked position, the lock magnet having a longitudinal axial end proximate the second end of the chamber, and the longitudinal axial end being defined by a lock magnet north pole and a lock magnet south pole;

wherein positioning a key magnet having an end defined by a key magnet north pole and a key magnet south pole proximate the second end of the chamber automatically magnetically attractively aligns the key magnet and the lock magnet about the longitudinal axial direction, attracts the lock magnet toward the key magnet, and moves the plunger to the unlocked position such that the detent may retract;

wherein the lock magnet further includes an outer circumferential surface adjacent the longitudinal axial end; and wherein the lock magnet has an annular shape including the outer circumferential surface and the longitudinal axial end.

14. The magnetic lock assembly of claim 13, wherein the lock magnet north pole and the lock magnet south pole each define substantially one-half of the longitudinal axial end.

15. A magnetic lock assembly, comprising:

a lock body defining a chamber having a first end and an opposite second end;

a plunger disposed within the chamber and being translatable in a longitudinal axial direction between a locked position and an unlocked position;

a resilient member urging the plunger toward the locked position;

a detent being extendable when the plunger is in the locked position and retractable when the plunger is in the unlocked position;

a lock magnet being translatable with the plunger as the plunger moves between the locked position and the unlocked position, the lock magnet having a longitudinal axial end proximate the second end of the chamber, and the longitudinal axial end being defined by a lock magnet north pole and a lock magnet south pole;

wherein positioning a key magnet having an end defined by a key magnet north pole and a key magnet south pole proximate the second end of the chamber automatically magnetically attractively aligns the key magnet and the lock magnet about the longitudinal axial direction, attracts the lock magnet toward the key magnet, and moves the plunger to the unlocked position such that the detent may retract; and wherein the lock magnet has an annular shape defined by a first semi-annular lock magnet section connected to a second semi-annular lock magnet section, the first semi-annular lock magnet section including the lock magnet north pole and the second semi-annular lock magnet section including the lock magnet south pole.

16. The magnetic lock assembly of claim 15, wherein the lock magnet north pole is a first lock magnet north pole and the lock magnet south pole is a second lock magnet south pole, the first semi-annular lock magnet section further including a first lock magnet south pole axially opposite the first lock magnet north pole, and the second semi-annular lock magnet section further including a second lock magnet north pole axially opposite the second lock magnet south pole.

17. The magnetic lock assembly of claim 13, wherein the lock magnet is fixedly supported by the plunger.

18. The magnetic lock assembly of claim 15, wherein the lock magnet is fixedly supported by the plunger.

* * * * *